US010633062B2

(12) United States Patent
Boonlikitcheva

(10) Patent No.: US 10,633,062 B2
(45) Date of Patent: Apr. 28, 2020

(54) FLOATING UNIT AND A FLOATING STRUCTURE ASSEMBLED FROM SUCH FLOATING UNITS

(71) Applicant: Pichit Boonlikitcheva, Bangkok (TH)

(72) Inventor: Pichit Boonlikitcheva, Bangkok (TH)

( * ) Notice: Subject to any disclaimer, the term of this patent is extended or adjusted under 35 U.S.C. 154(b) by 296 days.

(21) Appl. No.: 15/501,055

(22) PCT Filed: Mar. 27, 2015

(86) PCT No.: PCT/TH2015/000018
§ 371 (c)(1),
(2) Date: Feb. 1, 2017

(87) PCT Pub. No.: WO2016/053208
PCT Pub. Date: Apr. 7, 2016

(65) Prior Publication Data

US 2017/0274966 A1 Sep. 28, 2017

(30) Foreign Application Priority Data

Oct. 1, 2014 (TH) ..... 1401005953

(51) Int. Cl.
*B63B 35/38* (2006.01)
*B63B 3/08* (2006.01)
*B63B 35/34* (2006.01)

(52) U.S. Cl.
CPC ..... *B63B 35/38* (2013.01); *B63B 3/08* (2013.01); *B63B 35/34* (2013.01); *B63B 2221/00* (2013.01); *B63B 2241/02* (2013.01)

(58) Field of Classification Search
CPC ..... B63B 35/38; B63B 35/34
See application file for complete search history.

(56) References Cited

U.S. PATENT DOCUMENTS 4,604,962 A * 8/1986 Guibault ..... B63B 35/38 114/218
5,251,560 A * 10/1993 Ban ..... E02B 3/064 114/266

(Continued)

FOREIGN PATENT DOCUMENTS

CN 2642667 Y 9/2004
CN 2711039 Y 7/2005

(Continued)

OTHER PUBLICATIONS

International Search Report (ISR) dated Aug. 18, 2015 for International Application No. PCT/TH2015/000018.

(Continued)

*Primary Examiner* — S. Joseph Morano
*Assistant Examiner* — Jovon E Hayes
(74) *Attorney, Agent, or Firm* — Ladas & Parry LLP

(57) ABSTRACT

A floating unit capable of attaching to another floating unit by locks for assembling a floating structure according to this invention comprises a floating body being in the form of a hollow polygonal shape as viewed from a plan view. The floating body comprises an upper surface, a lower surface, and a plurality of lateral surfaces connected to said upper and lower surfaces. Said upper surface and said lower surfaces of the floating body comprise at least one upper engaging surface and at least one lower engaging surface respectively on each associated side of said polygonal floating body, wherein the upper and lower engaging surfaces are respectively adapted in order to be fitted with a locking surface of said lock, therefore, said floating body can be attached to a floating body of another floating unit.

31 Claims, 22 Drawing Sheets

(56) References Cited

U.S. PATENT DOCUMENTS

| | | | | |
|---|---|---|---|---|
| 5,281,055 | A * | 1/1994 | Neitzke | B63B 35/38 405/219 |
| 5,682,833 | A * | 11/1997 | Eva, III | B63B 3/08 114/263 |
| 6,006,687 | A | 12/1999 | Hillman et al. | |
| 6,033,151 | A * | 3/2000 | Tsou | B63B 3/08 114/266 |
| 7,243,608 | B2 * | 7/2007 | Knight, Jr. | B63B 35/38 114/263 |
| 7,603,959 | B1 * | 10/2009 | Veazey | B63B 3/08 114/263 |
| 8,037,837 | B2 * | 10/2011 | La Violette | B63B 3/08 114/263 |
| 8,783,199 | B2 * | 7/2014 | Shih Cion Shen | B63B 35/58 114/266 |
| 2004/0028478 | A1 * | 2/2004 | Lekhtman | B63B 3/08 405/219 |
| 2010/0300345 | A1 | 12/2010 | La Violette et al. | |
| 2012/0260841 | A1 | 10/2012 | Shih Cion Shen | |
| 2013/0008900 | A1 * | 1/2013 | Wu | B63B 35/38 220/200 |
| 2017/0274966 | A1 * | 9/2017 | Boonlikitcheva | B63B 35/34 |

FOREIGN PATENT DOCUMENTS

| | | | |
|---|---|---|---|
| CN | 2712793 | V | 7/2005 |
| CN | 200939934 | Y | 8/2007 |
| CN | 203186552 | U | 9/2013 |
| CN | 203345169 | U | 12/2013 |
| EP | 0 385 903 | A1 | 9/1990 |
| EP | 2 682 336 | A1 | 1/2014 |
| EP | 2692624 | A1 | 2/2014 |
| JP | 49111388 | A | 10/1974 |
| JP | 62151198 | U | 9/1987 |
| JP | 54598 | A | 1/1993 |
| JP | 2012-232651 | A | 11/2012 |
| KR | 1020080093477 | A | 10/2008 |
| WO | 2006075831 | A1 | 7/2006 |

OTHER PUBLICATIONS

Written Opinion (WO) dated Aug. 20, 2015 for International Application No. PCT/TH2015/000018.
Espacenet English abstract of CN 200939934 Y.
Espacenet English abstract of CN 2711039 Y.
Espacenet English abstract of JP 2012-232651 A.
Espacenet English abstract of EP 0 385 903A1.
First Chinese Office Action dated Jun. 27, 2018 for Application No. CN 201580047914.6.
Japanese Office Action dated Jan. 31, 2019 for Application No. JP 2017-518268.
Espacenet English abstract of CN 2642687 Y.
Espacenet English abstract of CN 203345169 U.
Espacenet English abstract of CN 2712793 Y.
Espacenet English abstract of CN 203186552 U.
Espacenet English abstract of JP 54598 A.
Korean Office Action with an English translation dated Sep. 16, 2019 for Application No. KR 10-2017-7005383.
Espacenet English abstract of KR 1020080093477 A.

* cited by examiner

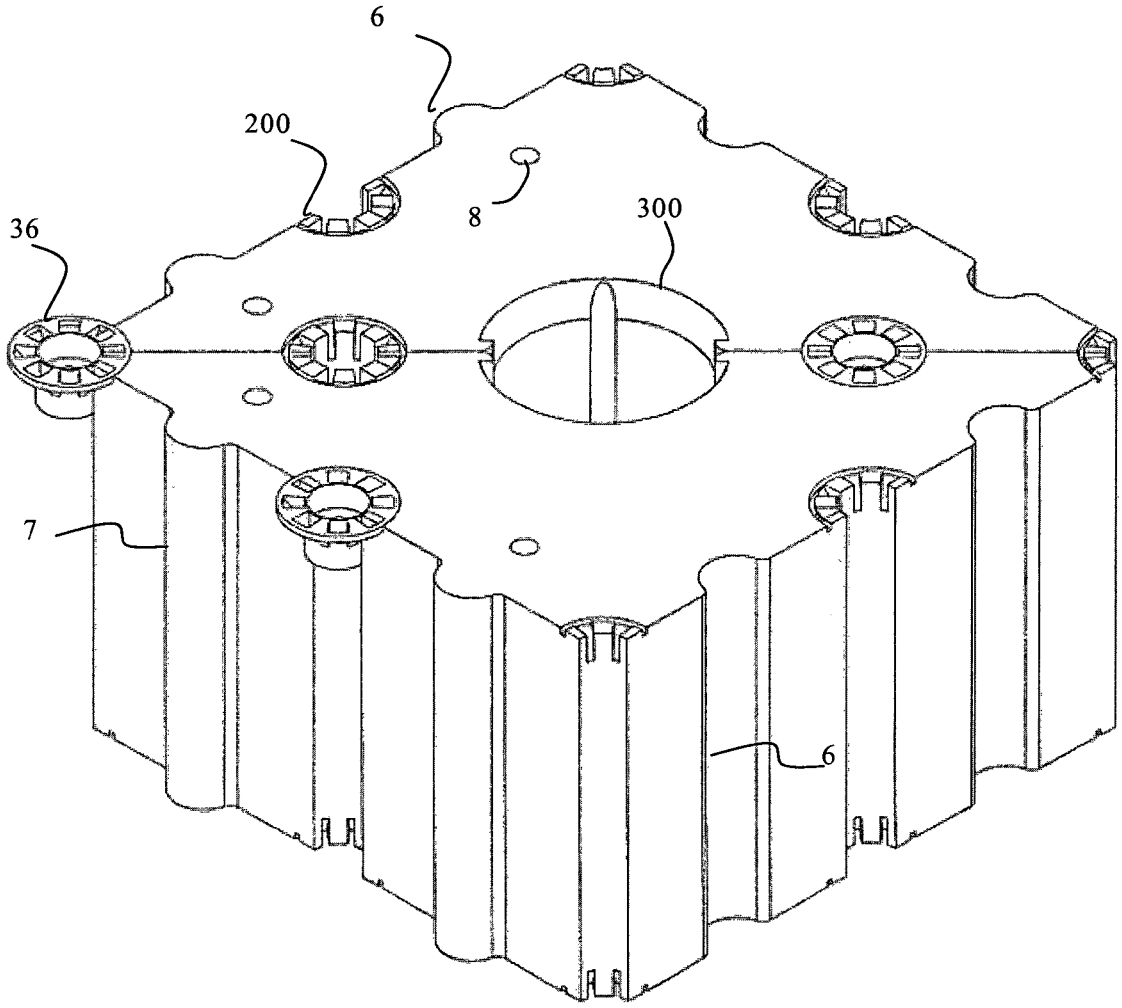
[FIG. 5]

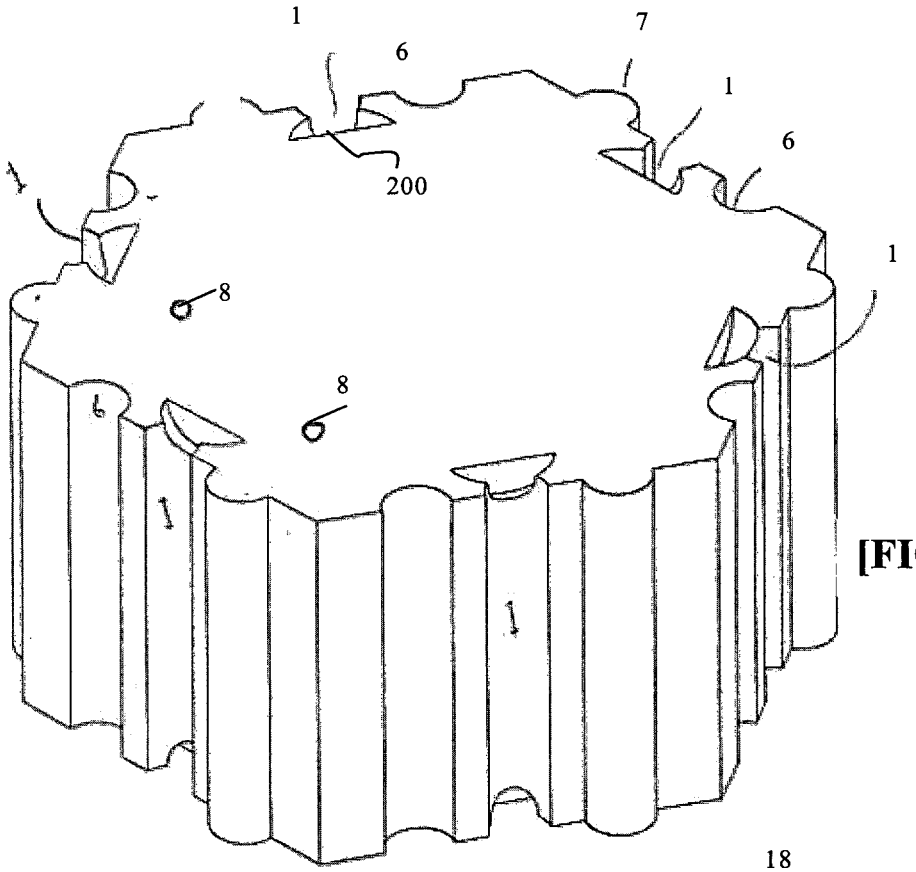
[FIG. 6A]
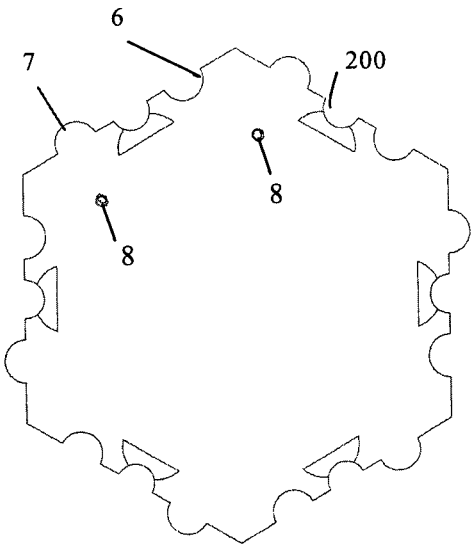
[FIG. 6B]
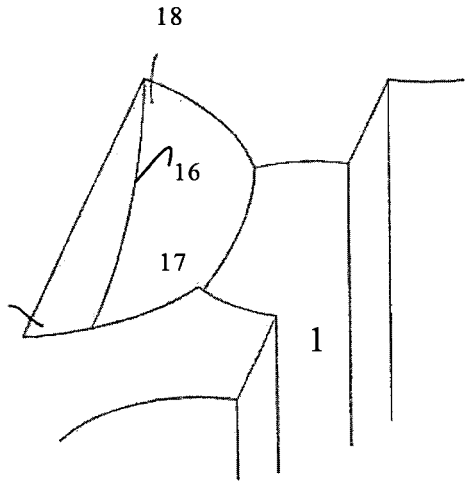
[FIG. 6C]

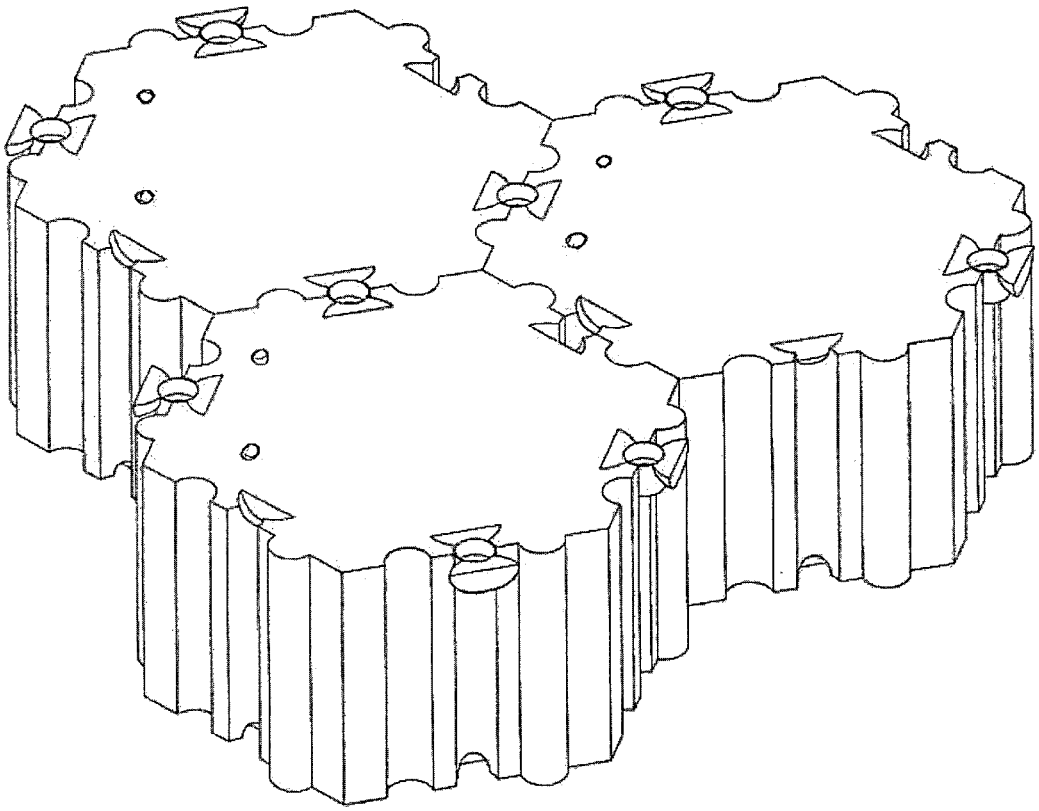
[FIG. 7]

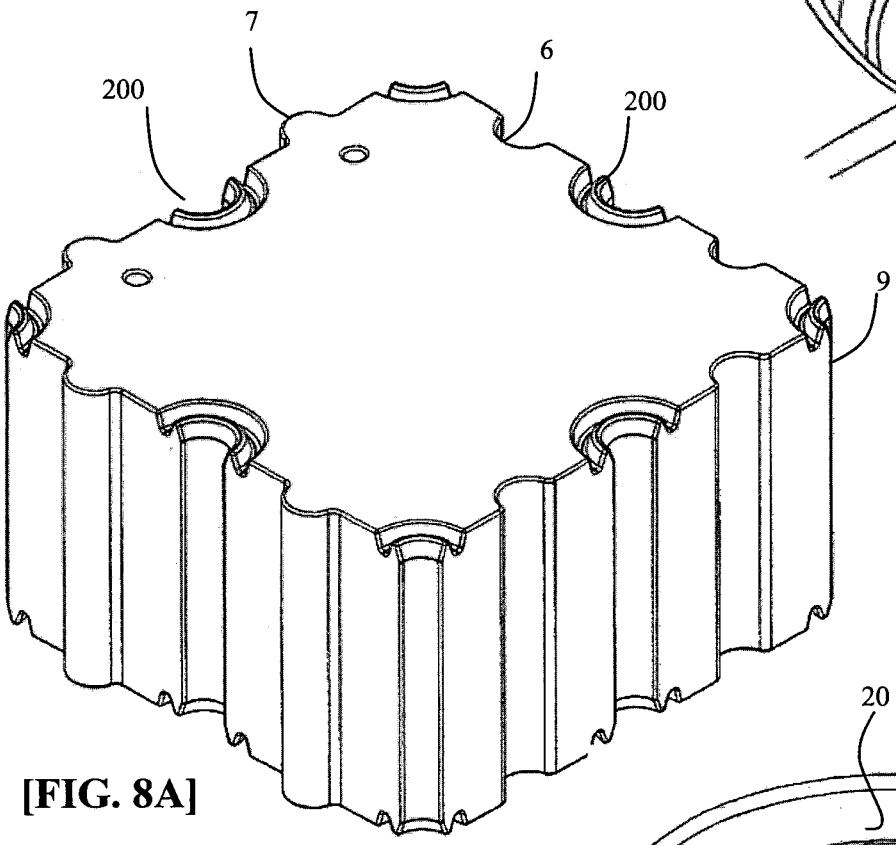
[FIG. 8A]
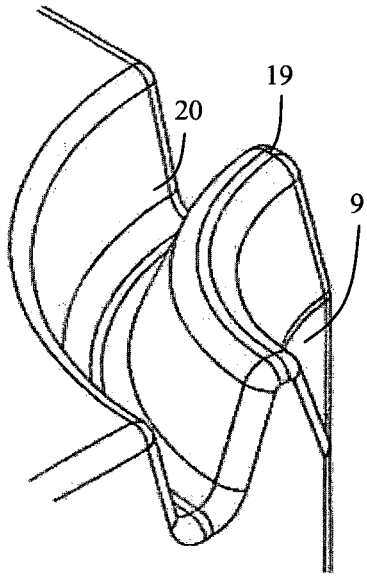
[FIG. 8B]
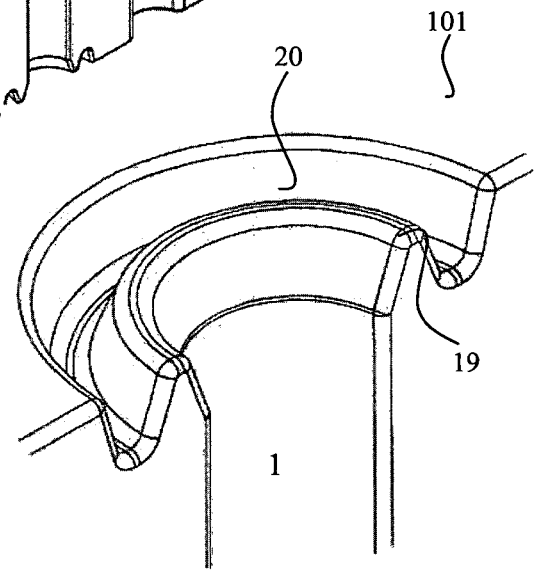
[FIG. 8C]

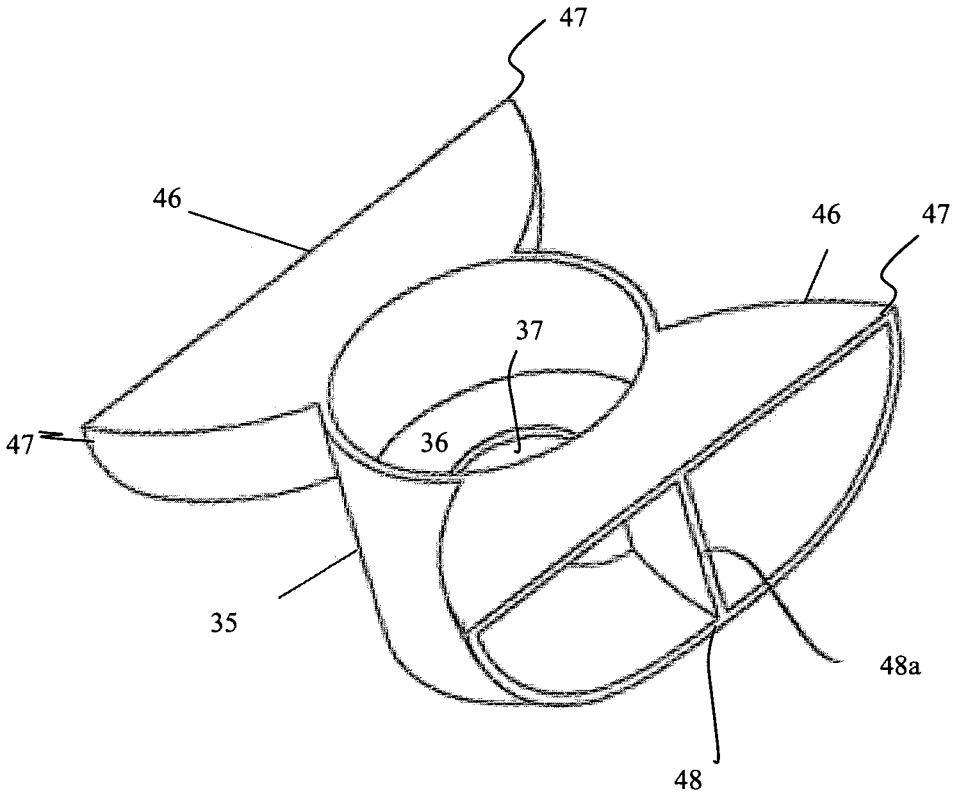
[FIG. 16]

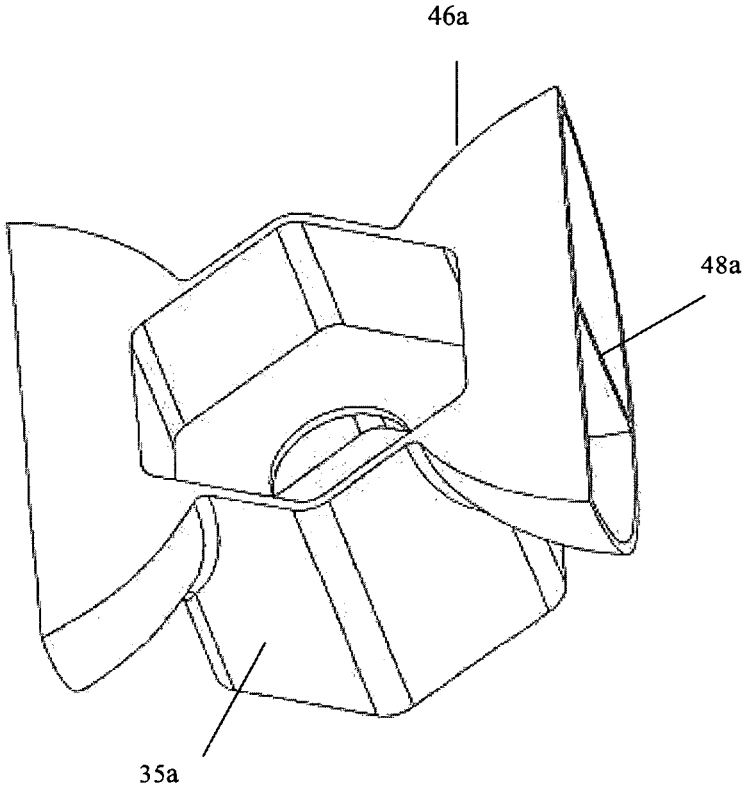
[FIG. 17]

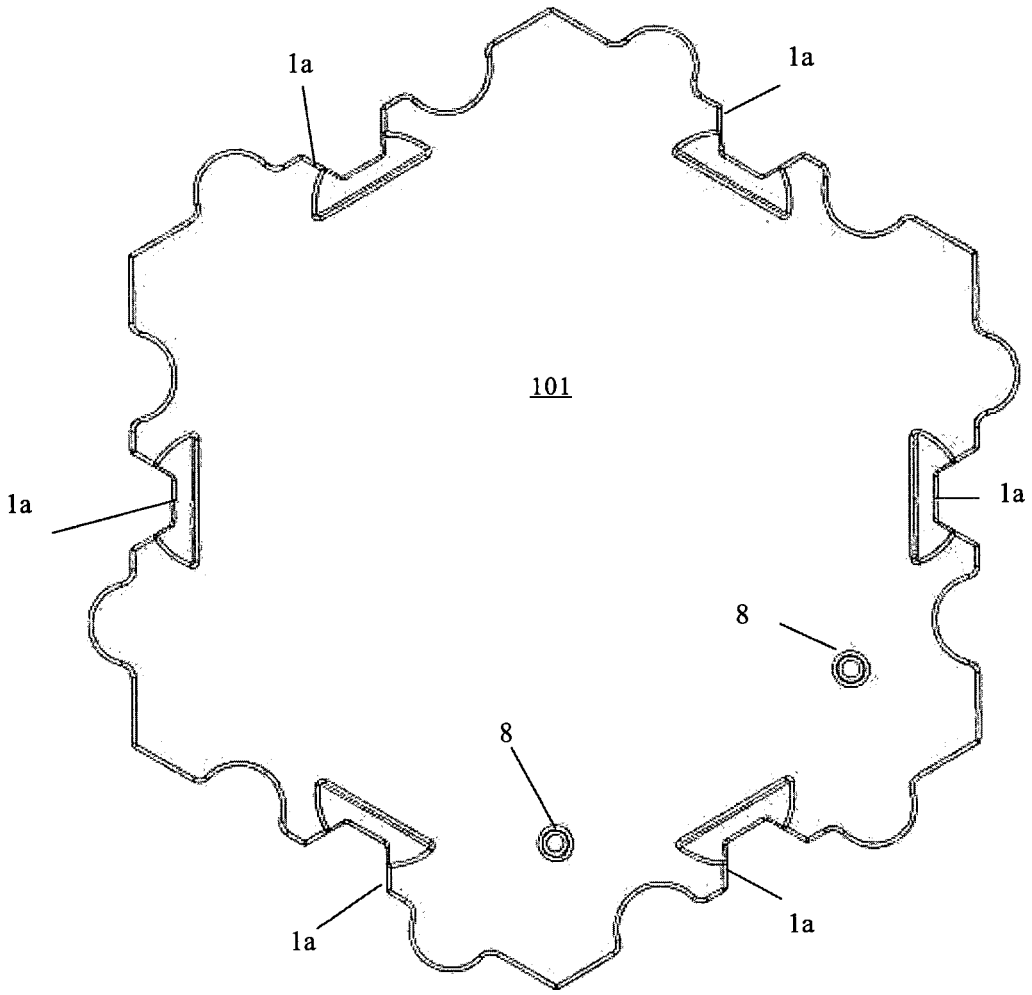
[FIG. 18]

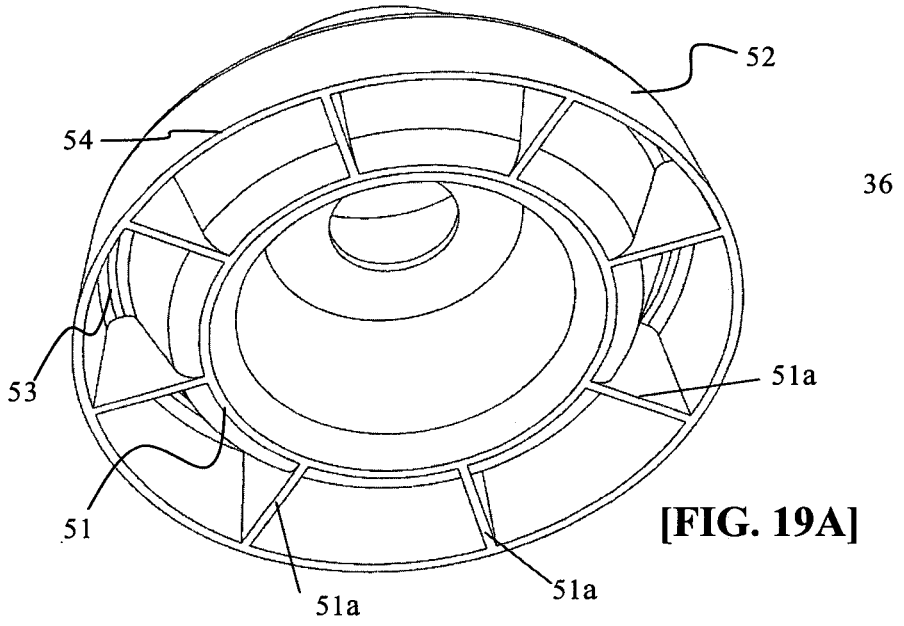
[FIG. 19A]
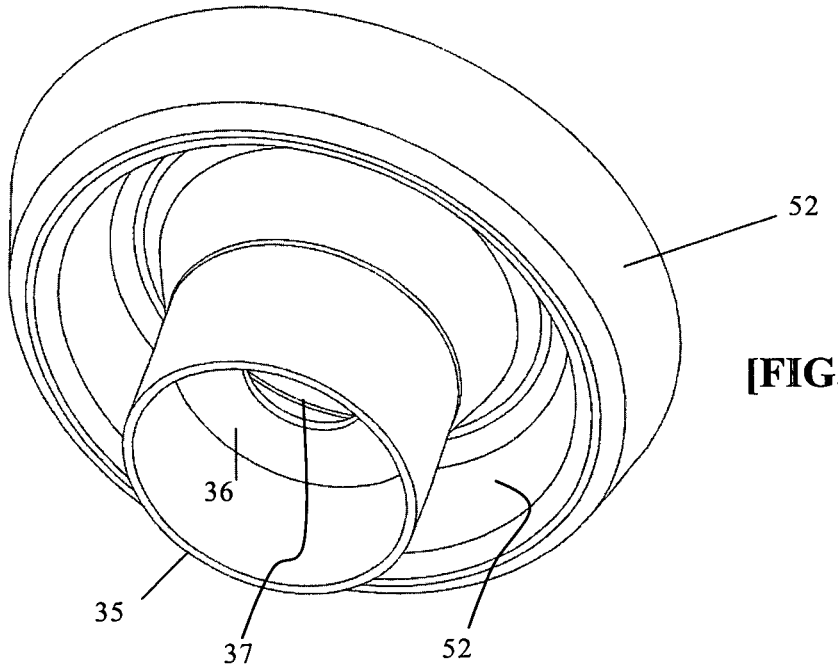
[FIG. 19B]

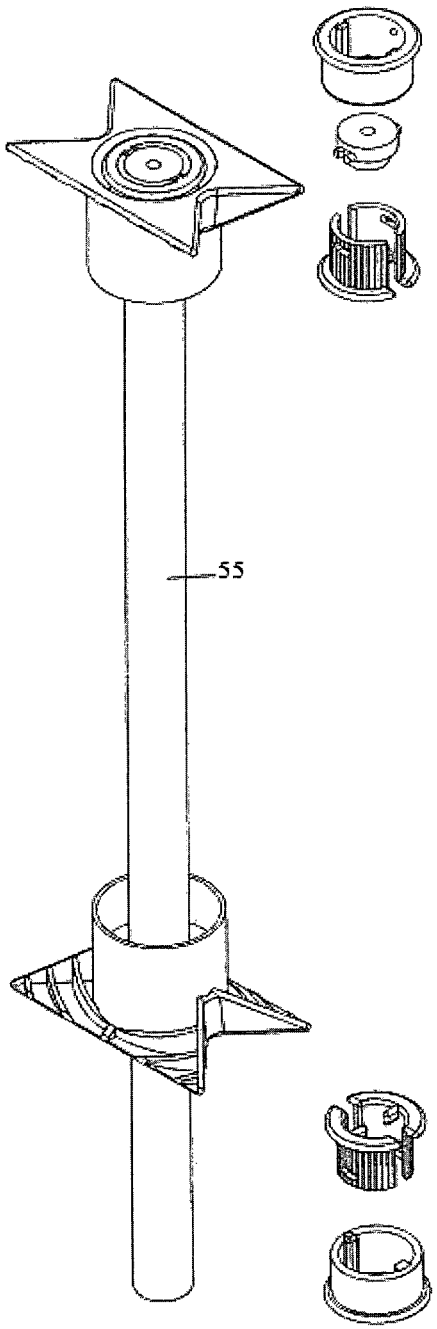
[FIG.20A]
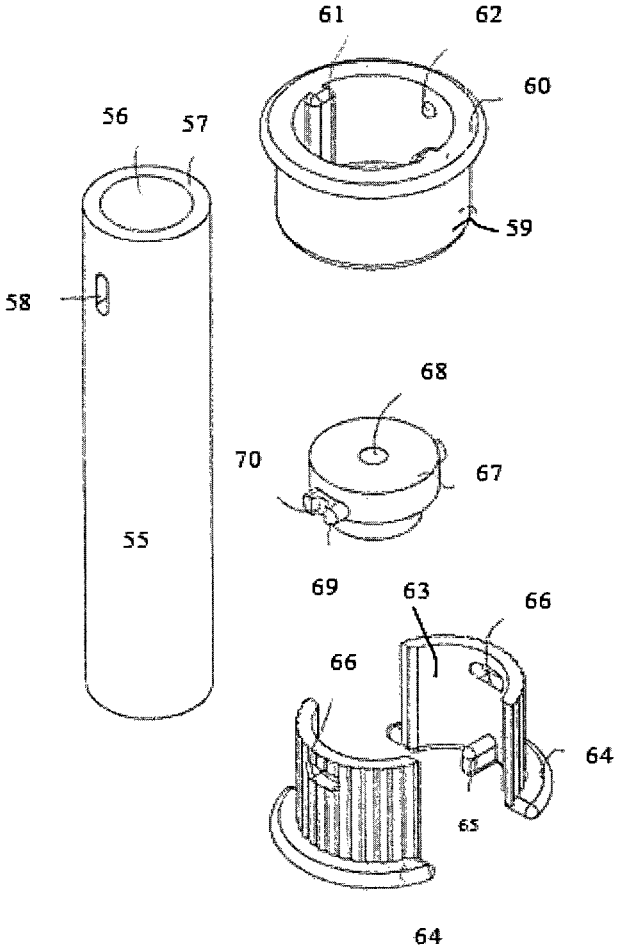
[FIG.20B]

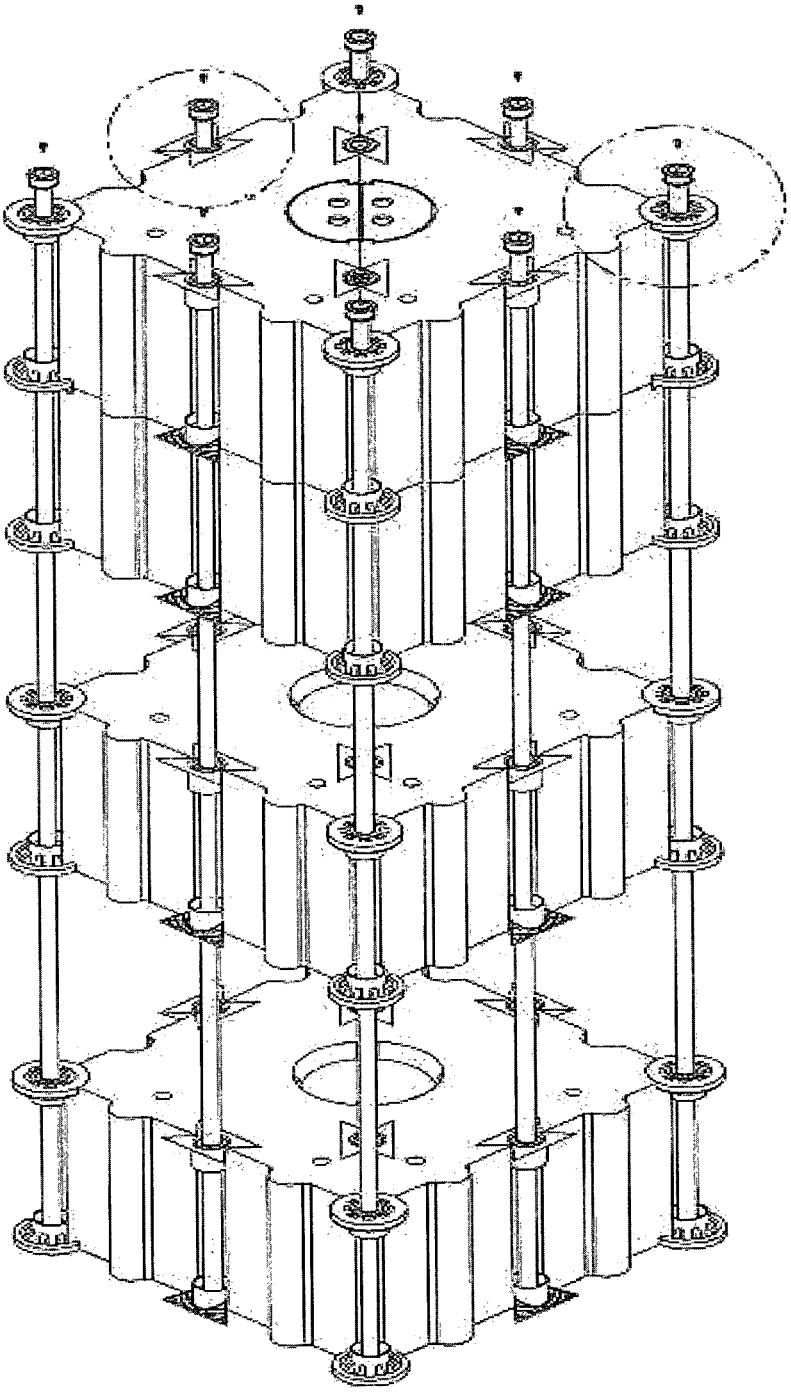
[FIG. 23]

FLOATING UNIT AND A FLOATING STRUCTURE ASSEMBLED FROM SUCH FLOATING UNITS

RELATED APPLICATION

This application is an application under 35 U.S.C. 371 of International Application No. PCT/TH2015/000018 filed on Mar. 27, 2015, the entire contents of which are incorporated herein by reference.

FIELD OF THE INVENTION

The invention relates to a floating unit and a floating structure constructed by assembling said floating units.

BACKGROUND ART

Floating structures such as a dock, a jetty, a raft, etc. constructed from a single floating unit or a plurality of floating units assembled together, which can be utilized or towed, are well known.

For the floating structure constructed from a plurality of floating units assembled together, U.S. Pat. No. 8,037,837 B2 assigned to Candock Inc., Canada, discloses a dock unit attachable to another dock unit with a fastener for forming a floating dock. Likewise, for assembling a plurality of floating units as disclosed in European patent application, publication No. EP 2 682 336 A1 owned by Marine System Europa S.L., Spain, floating units are interlinked to each other in a jointed form by means of connectors being in the form of perforated projections and bolts.

In said existing inventions as described above, the floating unit has protrusions each of which is laterally extended for receiving the respective fasteners or bolts, thereby the floating unit can be attached to another floating unit. This structure has several disadvantages including: these components are easily damaged; and the components of the floating unit formed by a plastic molding may leads to a complicated mold, so that it may cause increases in production cost of the floating unit.

Meanwhile, in the invention according to European patent application, publication No. EP 0 385 903 A1 owned by S. A. Ateliers Polyvalents Chateauneuf, France, floating units are attached together by using bolts and nuts having four horizontal arms each of which is adapted in order to be fitted into a cavity on the lower surface of the floating unit, so that the floating units can be attached together without using any protrusions for receiving the bolts. However, since said floating units are attached together by screwing-in force for the bolts, it is possible that the bolts may be loosened.

SUMMARY OF THE INVENTION

In order to overcome the problems as mentioned above, an objective of the present invention is to provide a floating unit capable of attaching to another floating unit by locks for assembling a floating structure which is simple and not complex, so that the manufacturing cost is low. The floating units can be locked together by the locks without using screws or other fastening means, so that the floating units can be easily assembled and firmly attached together.

In addition, another objective of this invention is to construct a multi-floor floating structure with or without a space between floors, wherein the lower floor(s) is weighed by a material with a density higher than that of water such as sand, concrete, etc., so that the floating structure is more stable and can be further utilized.

The floating unit capable of attaching to another floating unit by the locks for constructing the floating structure according to this invention comprises a floating body being in the form of a hollow polygonal shape as viewed from above. The floating body comprises an upper surface, a lower surface, and a plurality of lateral surfaces connected to said upper surface and said lower surface. Said upper surface and said lower surface of the floating body respectively comprise at least one upper engaging surface and at least one lower engaging surface respectively on each associated side of said polygonal floating body, wherein the upper and lower engaging surface are respectively adapted in order to be fitted with a locking surface of said lock. Therefore, said floating body can be attached to a floating body of another floating unit.

The foregoing and other objectives and features of this invention will become more clearly apparent from the following detail description of this invention as illustrated in the accompanying drawings.

BRIEF DESCRIPTION OF THE DRAWINGS

FIG. 5 shows a process for assembly the floating units according to FIG. 4 in order to construct a single-floor floating structure;

FIGS. 6A-6C show the fifth embodiment of the floating unit according to this invention;

FIG. 7 shows a process for assembly the floating units according to FIG. 6 together in order to construct a single-floor floating structure;

FIGS. 8A-8C show the sixth embodiment of the floating unit according to this invention;

FIG. 16 shows another form of the main lock-connecting element of the lock served as the element engaged to the engaging surface of the floating unit according to the fifth embodiment as shown in FIG. 6;

FIG. 17 shows another form of the main lock-connecting element of the lock served as the element engaged to the engaging surface of the floating unit according to the seventh embodiment;

FIG. 18 shows the seventh embodiment of the floating unit according to this invention used with the main lock-connecting element as shown in FIG. 17;

FIG. 19 shows another form of the main lock-connecting element of the lock served as the element engaged to the engaging surface of the floating unit according to the sixth embodiment as shown in FIG. 8;

FIG. 20 shows detail of the lock comprising a locking rod, an inner lock-inserting element, a locking element, and a lock-inserting element.

FIG. 23 shows the second example of a three-floor floating structure constructed by assembling the floating units according to this invention.

DETAILED DESCRIPTION

Figure 1:
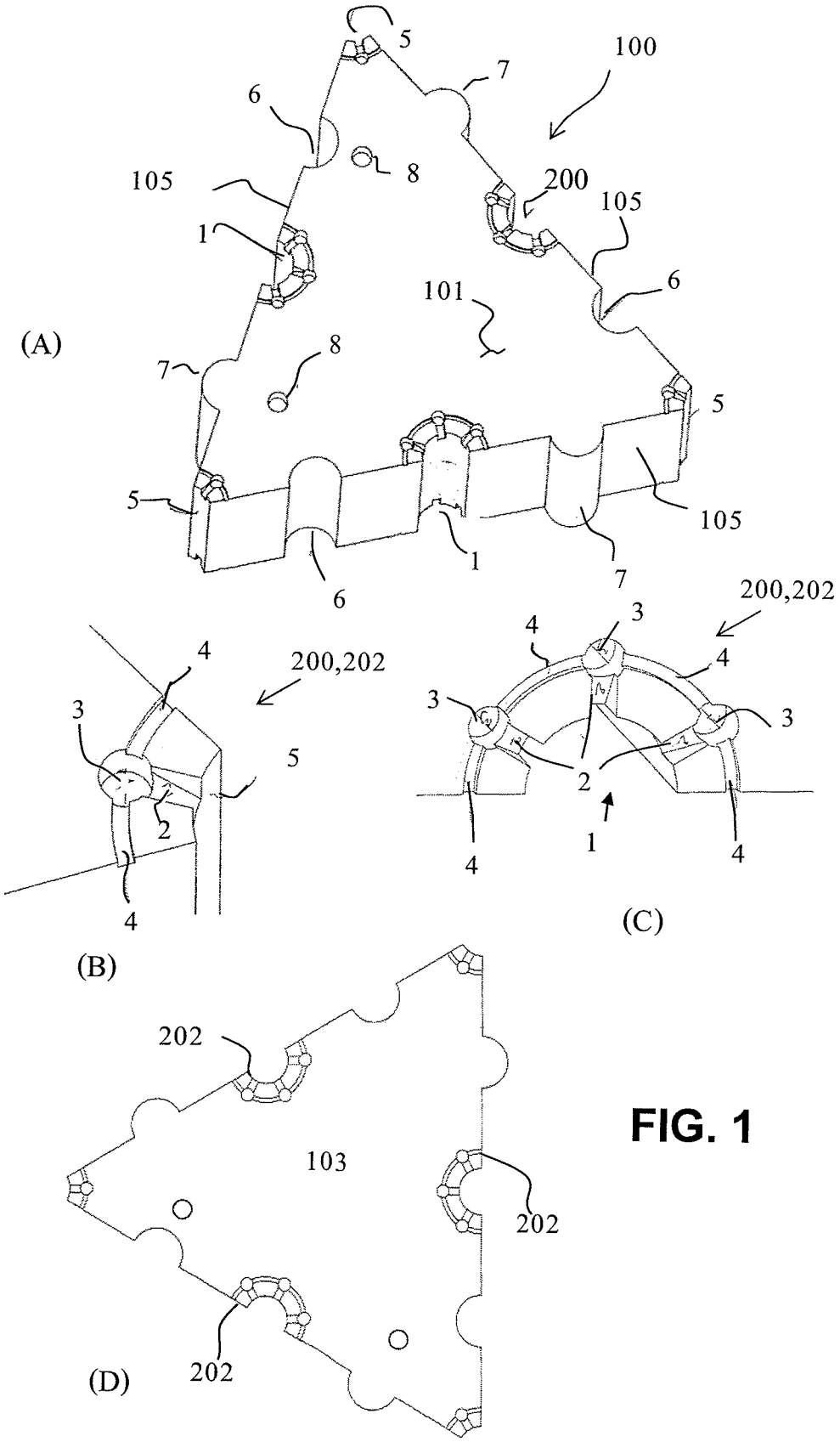
FIGS. 1A-1D show the first embodiment of a floating unit according to this invention.

A floating unit according to this invention is in the form of a hollow polygonal floating unit, and preferably made of a plastic material such as high-density polyethylene (HDPE), polyprolylene random copolymer (PPR), polyester, polycarbonate, ABS plastic, or similar plastic materials, or a metal such as aluminium, rust-preventive plated iron, etc. The floating unit is formed such that lateral surfaces, corners, an upper surface, and a lower surface have the structure capable of attachment for an extension in a longitudinal direction of all lateral surfaces, and an extension in a vertical direction of the upper and lower surfaces. The embodiments of this invention are only exemplified for clear disclosure in detail description of this invention, and the enlarged figures and the additional figures are provided for clarity of the disclosure.

According to one embodiment, the floating unit according to this invention can be attached to another floating unit by locks for constructing the floating structure, wherein said floating unit comprises a floating body being in the form of a hollow polygonal shape as viewed from above. The floating body comprises an upper surface, a lower surface, and a plurality of lateral surfaces connected to said upper and lower surfaces. Said upper surface and said lower surfaces of the floating body comprise at least one upper engaging surface and at least one lower engaging surface respectively on each associated side of said polygonal floating body, wherein the upper and lower engaging surfaces are respectively adapted in order to be fitted with a locking surface of said lock, therefore, said floating body can be attached to a floating body of another floating unit, and said upper and lower engaging surfaces of said floating body respectively comprise a number of notches, each of which has a contact surface inclined outwardly of said floating body, wherein, in use, the corresponding contact surfaces of the notches of said upper engaging surface and the corresponding contact surfaces of the notches of said lower engaging surface are contacted with the locking surfaces of said locks, therefore, said floating unit can be attached to another floating unit.

According to another embodiment of this invention, the floating unit can be attached to another floating unit by the locks for constructing the floating structure, wherein said floating unit comprises a floating body being in the form of a hollow polygonal shape as viewed from above. The floating body comprises an upper surface, a lower surface, and a plurality of lateral surfaces connected to said upper and lower surfaces. Said upper surface and said lower surface of the floating body comprise at least one upper engaging surface and at least one lower engaging surface respectively on each associated side of said polygonal floating body, wherein the upper and lower engaging surfaces are respectively adapted in order to be fitted with a locking surface of said lock, and therefore, said floating body can be attached to a floating body of another floating unit, and said upper and lower engaging surfaces of said floating body respectively comprise a peripheral groove 10 and a radial groove(s) 2 communicated with said peripheral groove, in which contact surfaces of said upper engaging surface 200 and said lower engaging surface 202 are inclined, wherein, in use, the corresponding peripheral grooves (10), radial recesses 2 and contact surfaces of said upper engaging surface 200 and of said lower engaging surface 202 are contacted with the locking surfaces of said locks, therefore, said floating unit can be attached to another floating unit.

According to another embodiment of this invention, the floating structure comprises a plurality of floating units according to one of the embodiments of this invention and a plurality of locks, wherein each said floating unit is attached to another floating unit by said locks respectively comprising: a locking rod being in the form of a hollow cylindrical rod with at least two holes pierced through the wall of said locking rod and located adjacent to one end of said locking rod; a lock-connecting element having a central through hole adapted for snugly inserting of said locking rod therethrough, wherein said lock-connecting element comprises an engaging surface capable of snugly engaging with said upper engaging surface or said lower engaging surface of said floating unit; a pair of lock-engaging elements, wherein each lock-engaging element is in the form of an arc-shaped portion capable of snugly enclosing the outside of the locking rod, and the inside of each lock-engaging element is provided with at least one latch for snugly inserting into the corresponding hole of the locking rod, while said pair of lock-engaging elements is enclosed the outside of the locking rod; and a lock-inserting element for putting on and covering on the end of the locking rod, while the outside of the locking rod is snugly enclosed by the pair of said lock-engaging elements, wherein, in use, an edge of each lock-engaging element is abutted on the corresponding lock-connecting element, such that the engaging surface of said lock-connecting element is locked onto said corresponding upper or lower engaging surfaces of at least two floating units together, whereby the floating units can be locked and attached together, and the floating structure can be constructed therefrom.

The detailed description of this invention is given hereafter in a way of exemplary embodiments of this invention and taken in conjunction with the appended drawings, in which like elements in the appended drawings are identified by like reference numerals. While particular embodiments of the present invention have been illustrated and described, it is not intended to limit this invention, and the scope of this invention is defined in the appended claims.

FIGS. 1A-1D show the first embodiment of the floating unit capable of attaching to another floating unit by the locks for constructing the floating structure according to this invention.

According to FIG. 1A, the floating unit comprises the floating body 100 being in the form of a hollow equilateral triangular prism as shown an elevation view, while FIG. 1D is a plan view as viewed from below. The floating body 100 comprises an upper surface 101, a lower surface 103 (see FIG. 1D which is the plan view as viewed from below), and three lateral surfaces 105 connected to said upper surface 101 and said lower surface 103.

FIGS. 1B and 1C show the engaging surfaces located at the corners and the lateral edge respectively. The floating body 100 is provided with the upper engaging surfaces 200 located at the corner (as shown in FIG. 1B) and the lateral edge (at least one engaging surface on each lateral edge of said polygonal-shaped floating body, as shown in FIG. 1C), and the lower engaging surfaces 202 (see FIG. 1D). The lower engaging surfaces 202 are identical and appear to be a mirror image of the upper engaging surfaces 200.

Each upper and lower engaging surface (200 and 202) is adapted in order to fitted with the locking surface of the lock, wherein the detail of the lock will be described hereafter. Therefore, said floating body can be attached to a floating body of another floating unit.

These engaging surfaces serve as surfaces for facilitating assembly with another floating unit and assembly with external connecting devices in both horizontal and vertical directions.

According to FIG. 1A, at least one lateral surface 105 of the floating body 100 may be provided with a main concave portion 1 and/or a recess 6 being in the form of a concave portion having a certain width and curvature, and the length fully extended along the lateral surface from the top to the bottom. The recess 6 is extended from the upper surface 101 to the lower surface 103 of the floating body. Likewise, it may be provided with at least one projection 7 being in the form of a convex portion outwardly extended and having a certain size and shape on the lateral surface of the floating body, such that the projection can be snugly engaged to the recess 6.

According to FIGS. 1B and 1C, at least one or a plurality of grooves 2 each of which has a certain width, length and depth, and not penetrated into the inside are formed on the respective regions of the upper surface and the lower surfaces located adjacent to the main concave portion 1. The grooves 2 located adjacent to the main concave portion 1 are periodically spaced apart on both upper and lower surfaces. The depression(s) 3 having a certain diameter and depth and not penetrated into the inside is(are) formed on the respective regions of the upper and lower surfaces of the floating unit. The depression 3 can also be an elliptic shape or another shape and is communicated to the corresponding groove 2, wherein the depth of one end of the groove 2 located near the depression 3 is shallower than that of the other end of the groove 2 located near the main concave portion 1, such that the groove 2 is upwardly inclined from the main concave portion 1 to the depression 3. A curved groove 4 having a certain width, curvature and depth, and not penetrated into the inside may be formed on the respective regions of the upper and lower surfaces of the floating unit, wherein the curved groove 4 is communicated with the corresponding and existing depressions 3, and both ends of the curved groove 4 are terminated at the respective left and right sides or the corresponding same side of the equilateral triangular prism-shaped floating unit.

At least one of either side of the floating unit is provided with at least one recess 6 having a certain width and the length fully extended along the side from the upper engaging surface to the lower engaging surface, so that the projection 7 of another floating unit required to be attached thereto can be engaged to this recess. Likewise, at least one of either side of the equilateral triangular prism-shaped floating unit is provided with at least one projection 7 having a certain width and the length fully extended along the lateral surface between the upper engaging surface and the lower engaging surface, so that the recess 6 of another floating unit required to be attached thereto can be engaged to this projection.

According to FIG. 1B, the 60-degree corner of the hollow equilateral triangular prism-shaped floating unit may be provided with a main concave portion 5 or a recess 6 being in the form of a concave portion having a certain width for inserting a shaft of the lock, or it can be a beveled portion at this corner fully extended between the upper engaging surface and the lower engaging surface.

Said upper engaging surface 200 and said lower engaging surface 202 of said floating body have the same features. Each engaging surface comprises a peripheral groove 4 being in the form of a groove extended into the surface, and a plurality of radial grooves 2 obliquely extended, communicated with the peripheral groove 4, and having a ridge at both walls of the groove, such that movement of the lock (not shown) can be prevented by the walls of said peripheral groove 4. This ridge may have an inclined contact surface being in the form of a wedge in order to produce friction between the engaging surface and the lock. While being used, the peripheral groove 4 and the corresponding contact surface of the upper engaging surface 200 and the lower engaging surface 202 are engaged to the locking surface of the lock (not shown). Therefore, said floating unit can be firmly attached to another floating unit.

According to FIGS. 1B and 1C, a groove 2 being in the form of a inclined groove having a certain width, length and depth, and not penetrated into the inside are formed on the respective regions of the upper surface and the lower surface of the floating unit located adjacent to the main concave portion 5. A depression 3 having a certain diameter and depth, and not penetrated into the inside is formed on the respective regions of the upper and lower surfaces of the floating unit. The depression 3 can also be an elliptic shape or another shape and is communicated to the corresponding groove 4 and inclined groove 2, wherein the depth of one end of the groove 2 located near the depression 3 is shallower than that of the other end of the groove 2 located near the main concave portion 5, such that the groove 2 is upwardly inclined from the main concave portion 5 to the depression 3. At least one curved groove 4 having a certain width, curvature and depth, and not penetrated into the inside may be formed on the respective regions of the upper and lower surfaces of the floating unit, wherein the curved groove 4 is communicated with both left and right side of the depression 3, and both ends of the curved groove 4 are terminated at the respective adjacent sides of the equilateral triangular prism-shaped floating unit.

According to FIG. 1D, the hollow equilateral triangular prism-shaped floating unit has the lower surface which is identical to the upper surface as described above, so that it will not repeatedly described. An anti-slip surface may be arranged on the equilateral triangular prism-shaped floating unit in the form of an anti-slip groove pattern (not shown in this figure), an anti-slip coating layer, or an anti-slip sheet attached to the floating unit by an adhesive or screws. At least one hole 8 having a certain diameter and depth, and not penetrated into the inside may be arranged on the upper and lower surface of the floating unit, wherein the hole may have internal threads for facilitating fastening of a plug (not show), wherein the holes may be spaced apart with a certain distance. The hole 8 serves as a hole for filling a material with a density equal to or higher than that of water such as water, sand, cement concrete, etc. into the floating unit, and then the hole is closed, so that the floating unit is submerged in water as required. Furthermore, the hole can serve as a hole for filling air in order to expel liquid (water) out of the floating unit, so that the submerged floating unit can be lifted up. In addition, the hole 8 may have female threads or an internal threads, such that an external-threaded plug (not shown) served as a cap can be screwed into the hole.

Figure 2:
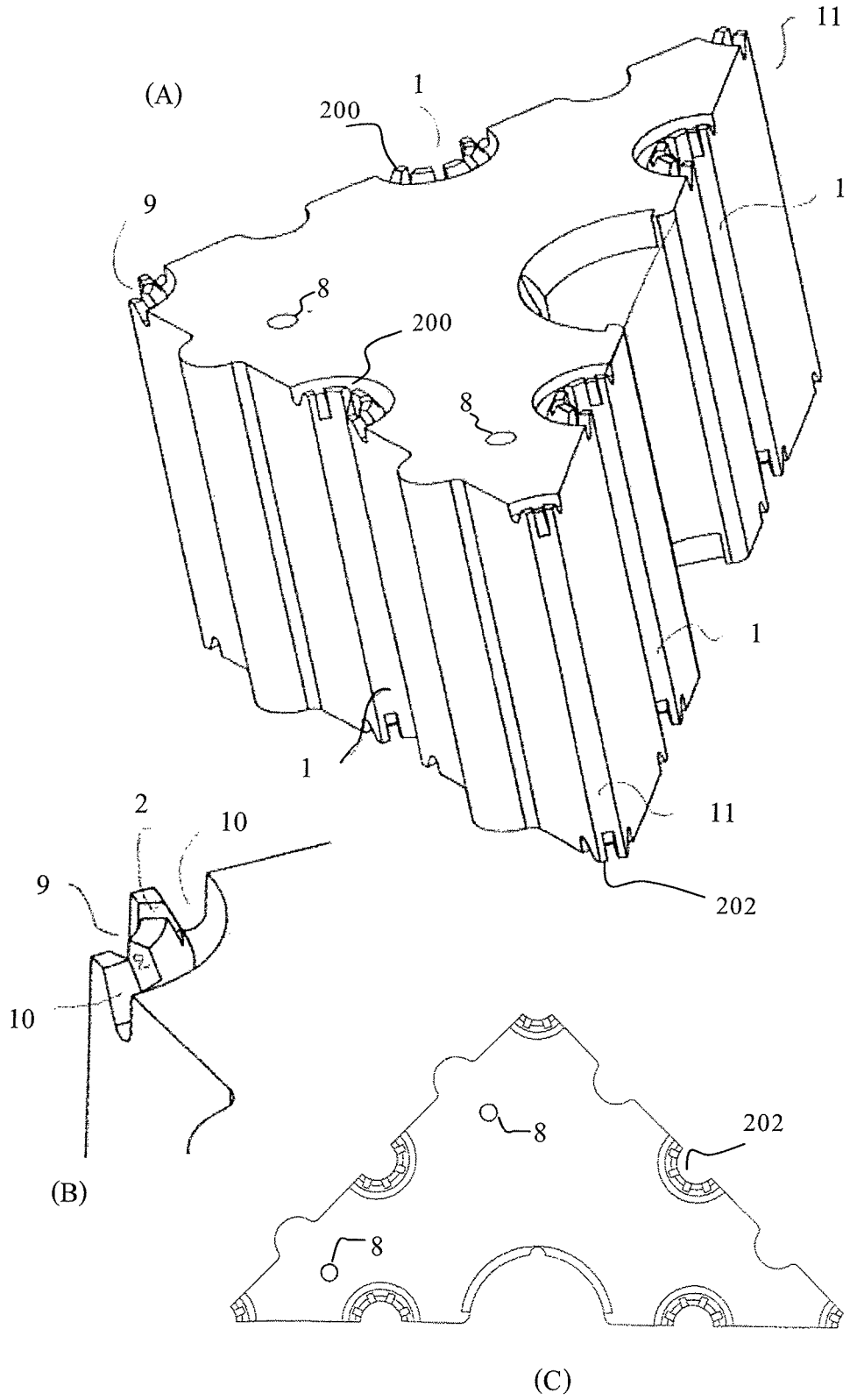
FIGS. 2A-2C show the second embodiment of the floating unit according to this invention.

FIGS. 2 A-2C show the second embodiment of a floating unit according to this invention, which is modified from the first embodiment, wherein the same parts are referred to by the same reference numbers.

According to FIGS. 2A and 2B, another structure for facilitating lock-connecting of an external device is shown. The floating body of the floating unit is in the form of the hollow right isosceles triangular prism. The floating body having a structure for facilitating assembly between the floating units comprises an upper engaging surface 200 and a lower engaging surface 202 for facilitating assembly with the external connecting device on the upper side and the lower side of the floating unit respectively.

FIG. 2B shows the engaging surface at the right-angle corner of the floating unit comprising a peripheral groove 10 and ridges located adjacent to the peripheral groove, wherein at least one inclined groove 2 having inclined surface radially extended are formed from the ridges for producing friction. A main concave portion 9 being in the form of a concave portion having a certain width may be formed at a right-angle corner for inserting of the lock, or it can be a beveled portion at the right-angle corner fully extended between the upper engaging surface and the lower engaging surface. At least one or a plurality of grooves 2 each of which has a certain width, length and depth, and not penetrated into the inside are formed on the respective regions of the upper surface and the lower surfaces located adjacent to the main concave portion 9. The grooves 2 located adjacent to the main concave portion 9 and periodically radially spaced apart, wherein this feature is the same on upper and lower surfaces. The respective regions of the upper and lower surfaces of the floating unit are provided with the curved groove 10 having a certain width, curvature and depth, not penetrated into the inside, and connected to the existing inclined grooves 2, and the respective inclined grooves 2 have the depth of one end communicated with the peripheral groove 10 shallower than that of the other end communicated with the main concave portion 9, such that the inclined groove 2 is inclined from the main concave portion 9 to the peripheral groove 10, and both ends of the peripheral groove 4 are terminated at the respective adjacent sides of the right-angle corner.

FIG. 2C shows the lower surface of the floating body, which is identical and appears to be a mirror image of the upper surface, therefore it is not repeatedly described.

FIG. 2A shows all three sides of the hollow right isosceles triangular prism-shaped floating unit, wherein at least one lateral surface of the floating body may be provided with a main concave portion 1 being in the form of a concave portion having a certain width and curvature, and the length fully extended along the lateral surface from the upper surface to the lower surface. The respective regions of the upper and lower surfaces located adjacent to the main concave portion 1 are provided with the peripheral groove 10 and a plurality of the inclined radial grooves 2 radially spaced apart. The inclined grooves 2 are communicated with the main concave portion 1 and periodically spaced apart. As assembling the floating unit to other floating units, on the respective regions of the upper and lower surfaces, the peripheral grooves 10 will substantially form an outer circle, and the ridges will substantially form an inner circle, as viewed from above.

According to FIG. 2, the 45-degree corner of the hollow right isosceles triangular prism-shaped floating unit may be provided with a main concave portion 11 being in the form of a concave portion or a beveled portion fully extended along the corner between the upper engaging surface and the lower engaging surface. The respective regions of the upper and lower surfaces of the floating unit located adjacent to the main concave portion 11 are provided with an inclined groove 2 having a certain width, length and depth, and not penetrated into the inside, and communicated with the main concave portion 11 on both upper and lower surfaces. The respective regions of the upper and lower surface of the floating unit are provided with the peripheral groove 10 having a certain width, curvature and depth, and not penetrated into the inside, and communicated with the inclined groove 2, and the inclined groove 2 having the depth of one end communicate with the peripheral groove 10 shallower than that of the other end communicated with the main concave portion 11, such that the inclined groove 2 is upwardly inclined from the main concave portion 11 to the peripheral groove 10, and both ends of the peripheral groove 10 are terminated at the respective adjacent sides of the corner.

According to FIG. 2A, at least one of either side of the hollow right isosceles triangular prism-shaped floating unit is provided with at least one engaging recess 6 and at least one engaging projection 7 having a size corresponding to the recess 6, such that the projection can be snugly engaged to the recess. The respective regions of the upper and lower surface of the hollow right isosceles triangular prism-shaped floating unit may be provided with an anti-slip groove pattern, or an anti-slip layer (not shown in this figure). The respective regions of the upper and lower surface of the floating unit are also provided with at least one hole 8 which is the same as the previous embodiments, and it is not repeatedly described.

FIGS. 3A-3C show the third embodiment of the floating unit according to this invention, wherein the same parts are referred to by the same reference numbers, and they will not be repeatedly described.

Figure 3:
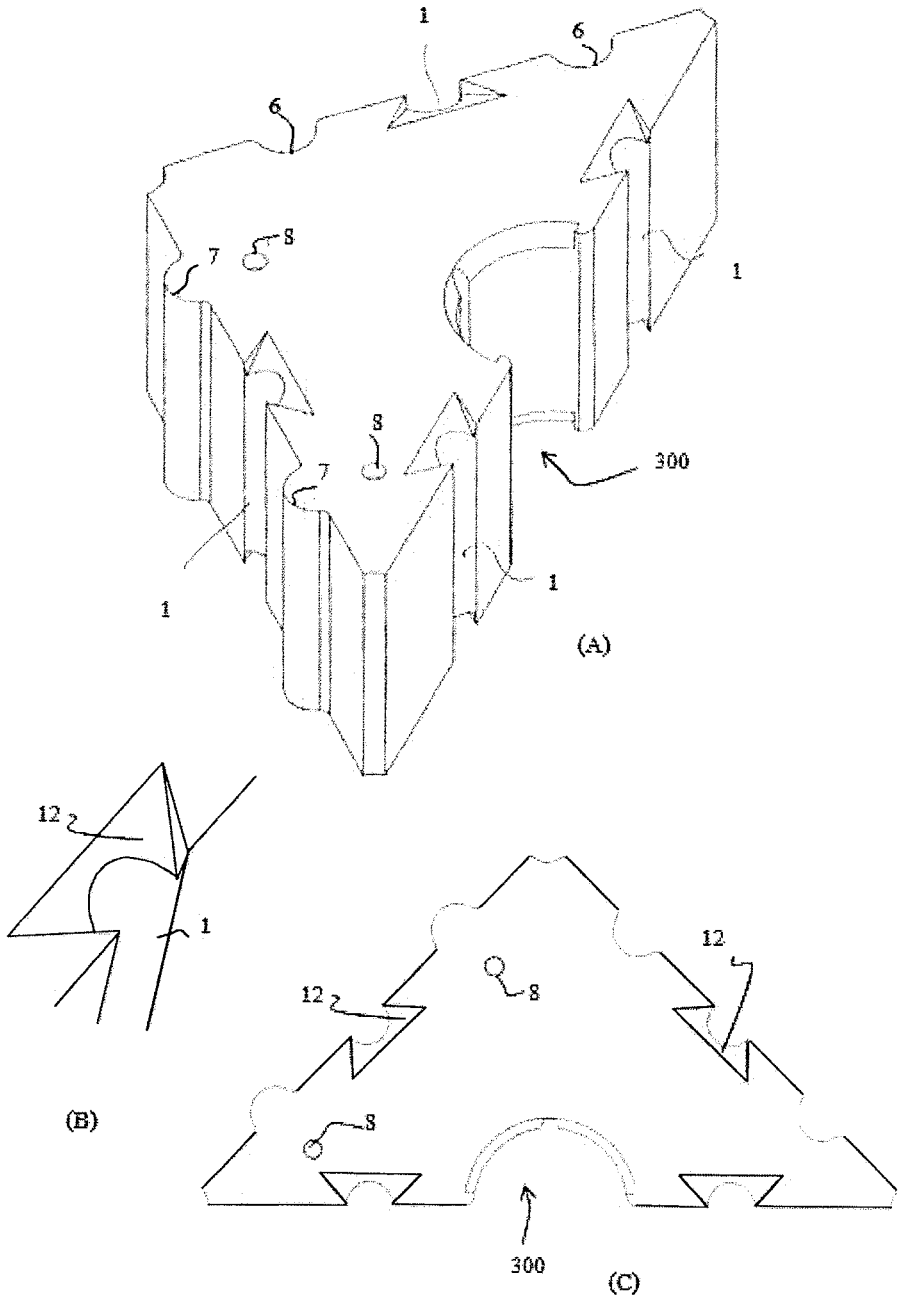
FIGS. 3A-3C show the third embodiment of the floating unit according to this invention.

According to FIG. 3, another structure of the floating unit for facilitating lock-connecting of an external device is shown. The floating body of the floating unit is in the form of the hollow right isosceles triangular prism having the structure for facilitating assembly between the floating units and assembly with the external connecting device on both horizontal and vertical directions. All three lateral surfaces of the floating unit may be provided with at least one main concave portion 1 or recess being in the form of a concave portion having a certain width and the length fully extended along the height of the lateral surface from the upper engaging surface to the lower engaging surface. The respective regions of the upper and lower surface of the floating unit located adjacent to the main concave portion 1 are provided with the upper and lower engaging surface respectively comprising notches 12 each of which is in the form of an outwardly downwardly inclined indentation, wherein the width of the notch 12 located toward the inside is more than that located toward the outside in the form of a widening indentation. The notch 12 has a certain width and depth, such that the widening inclined notch 12 can be engaged with the device required to be engaged thereto.

According to FIG. 3A, at least one of either side of the hollow right isosceles triangular prism-shaped floating unit is provided with at least one engaging recess 6 having a certain width and the length fully extended along the side from the upper engaging surface to the lower engaging surface, so that the engaging projection 7 of another floating unit required to be attached thereto can be engaged to this recess. Likewise, at least one of either side of the hollow right isosceles triangular prism-shaped floating unit is provided with at least one engaging projection 7 having a certain width and curvature, and the length fully extended along the lateral surface between the upper engaging surface and the lower engaging surface, so that the engaging recess 6 of another floating unit required to be attached thereto can be engaged to this projection. The respective regions of the upper and lower surface of the hollow right isosceles triangular prism-shaped floating unit may be provided with an anti-slip groove pattern, or an anti-slip layer (not shown in this figure). The respective regions of the upper and lower surface of the floating unit are also provided with at least one hole 8, wherein the holes may be spaced apart with a certain distance. The hole 8 serves as a hole for filling a material with a density equal to or higher than that of water into the floating unit, and then the hole is closed, so that the floating unit is submerged in water as required. Furthermore, the hole can serve as a hole for filling air in order to expel liquid (water) out of the floating unit, so that the submerged floating unit can be lifted up.

FIG. 3B is an enlarged view for illustrating the notch 12 on the engaging surface.

FIG. 3C shows the top plan view of the surface of the floating unit, wherein the lower surface is the same as the upper surface, and it appears to be a mirror image of the upper surface.

Figure 4:
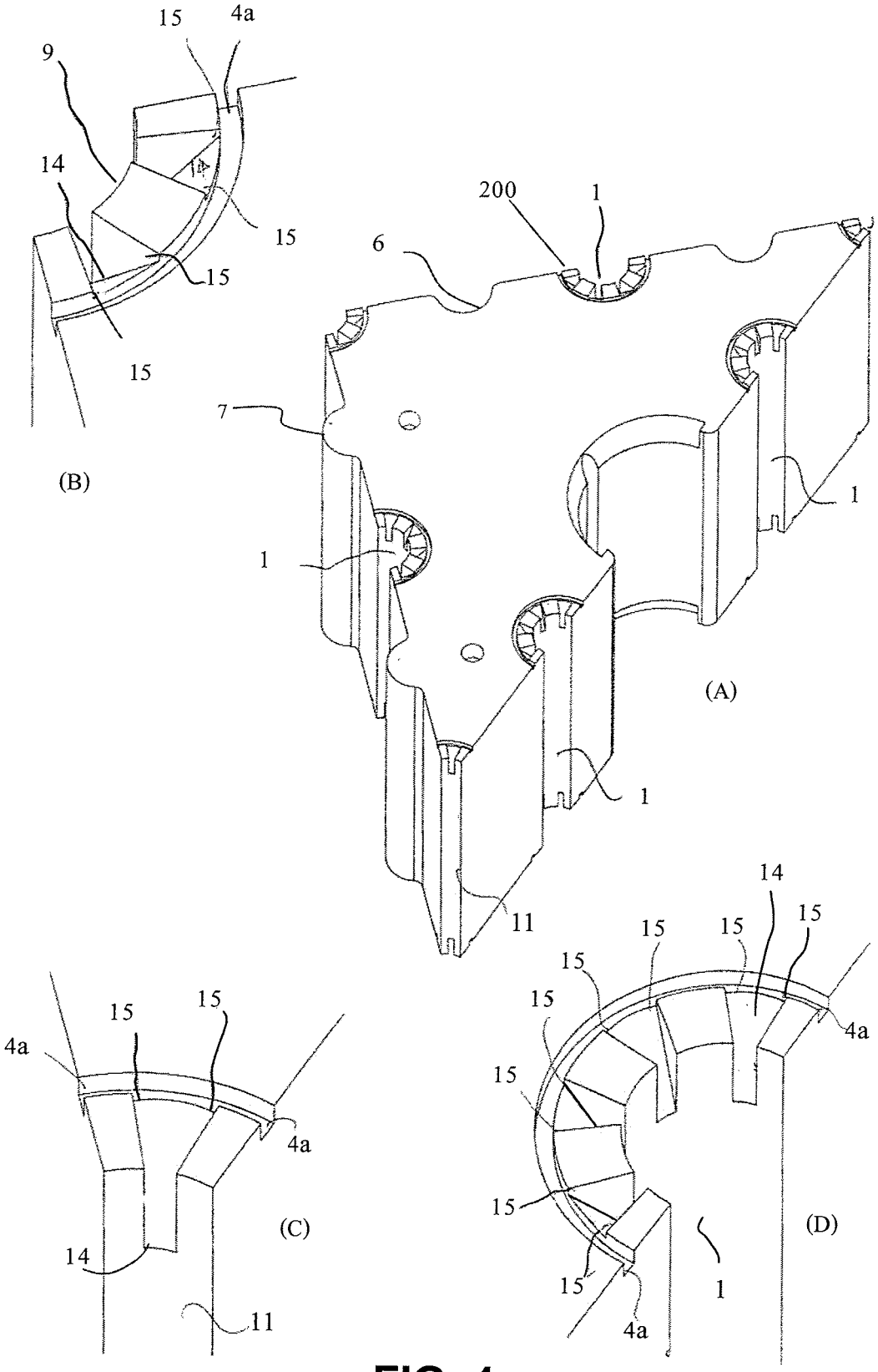
FIGS. 4A-4D show the forth embodiment of the floating unit according to this invention.

FIG. 4 shows the forth embodiment of the floating unit according to this invention, wherein the same parts are referred to by the same reference numbers, and they will not be repeatedly described.

According to FIG. 4, another structure of the hollow right isosceles triangular prism-shaped floating unit for facilitating lock-connecting of an external device is shown. The floating unit has the structure for facilitating assembly between the floating units and assembly with the external connecting device on both horizontal and vertical directions. At least one of either side of all three lateral surfaces of the floating unit may be provided with at least one main concave portion 1 or recess being in the form of a concave portion extended between the upper engaging surface 200 and the lower engaging surface 202 (not shown). The respective regions of the upper and lower surface of the floating unit located adjacent to the main concave portion 1 are provided with at least one or a plurality of inclined grooves or indentation 14, wherein they are periodically spaced apart. The widening inclined indentation 14 has a certain width and depth, and is widened and inclined toward the respective edge corners 15, such that the distance between the edge corners 15 is more than the width of the indentation 14 located adjacent to the main concave portion 1, and the space between the edge corners 15 is steeper than that of the indentation located adjacent to the main concave portion 1. A curved groove 4*a* having a certain width, depth, curvature and length, and not penetrated into the inside may be formed on the respective regions of the upper and lower surfaces of the floating unit, wherein the curved groove is formed in order to communicate the corresponding widening inclined indentations 14 at the existing edge corners 15 together, and both ends of the curved groove 4*a* are terminated at the respective left and right sides of the main concave portion on the corresponding same side.

According to FIG. 4B, the right-angle corner of the hollow right isosceles triangular prism-shaped floating unit is provided with at least one main concave portion 9 or recess being in the form of a concave portion having a certain width, or it can be a beveled portion at the right-angle corner fully extended between the upper engaging surface and the lower engaging surface. The respective regions of the upper and lower surface of the floating unit located adjacent to the main concave portion 9 are provided with at least one or a plurality of widening inclined indentation 14, wherein they are periodically spaced apart. The widening inclined indentation 14 has a certain width and depth, and is widened and inclined toward the respective edge corners 15, such that the distance between the edge corners 15 is more than the width of the widening inclined indentation 14 located adjacent to the main concave portion 9, and the space between the edge corners 15 is steeper than that of the indentation 14 located adjacent to the main concave portion 9. A curved groove 4*a* having a certain width, depth, curvature and length, and not penetrated into the inside may be formed on the respective regions of the upper and lower surfaces of the floating unit, wherein the curved groove is formed in order to communicate the corresponding widening inclined indentations 14 at the existing edge corners 15 together, and both ends of the curved groove 4*a* are terminated at the respective adjacent sides of the right-angle corner.

According to FIG. 4C, the 45-degree corner of the hollow right isosceles triangular prism-shaped floating unit may be provided with a main concave portion 11 or a recess being in the form of a concave portion having a certain width, or it can be a beveled portion at the corner fully extended between the upper engaging surface and the lower engaging surface. The respective regions of the upper and lower surface of the floating unit located adjacent to the main concave portion 11 are provided with at least one widening inclined indentation 14. The widening inclined indentation 14 has a certain width and depth, and is widened and inclined toward the respective edge corners 15, such that the distance between the edge corners 15 is more than the width of the widening inclined indentation 14 located adjacent to the main concave portion 11, and the space between the edge corners 15 is steeper than that of the indentation 14 located adjacent to the main concave portion 11. A curved groove 4*a* having a certain width, depth, curvature and length, and not penetrated into the inside may be formed on the respective regions of the upper and lower surfaces of the floating unit, wherein the curved groove is formed in order to communicate the corresponding widening inclined indentations 14 at the existing edge corners 15 together, and both ends of the curved groove 4*a* are terminated at the respective adjacent sides of the corner.

According to FIG. 4A, at least one of either side of the hollow right isosceles triangular prism-shaped floating unit is provided with at least one engaging recess 6 having a certain width and the length fully extended along the side from the upper engaging surface to the lower engaging surface, so that the engaging projection of another floating unit required to be attached thereto can be engaged to this recess. Likewise, at least one of either side of the hollow right isosceles triangular prism-shaped floating unit is provided with at least one engaging projection 7 having a certain width and curvature, and the length fully extended along the lateral surface between the upper engaging surface and the lower engaging surface, so that the engaging recess 6 of another floating unit required to be attached thereto can be engaged to this projection. The respective regions of the upper and lower surface of the hollow right isosceles triangular prism-shaped floating unit may be provided with an anti-slip groove pattern, or an anti-slip layer (not shown in this figure). The respective regions of the upper and lower surface of the floating unit are also provided with at least one hole 8 having a certain diameter and depth, and not penetrated into the inside, wherein the holes may be spaced apart a the certain distance. The hole 8 serves as a hole for filling a material with a density equal to or higher than that of water into the floating unit, and then the hole is closed, so that the floating unit is submerged in water as required. Furthermore, the hole can serve as a hole for filling air in order to expel liquid (water) out of the floating unit, so that the submerged floating unit can be lifted up.

FIG. 5 shows an example of a process for assembly the floating units according to FIG. 4 in order to construct a single-floor floating structure.

According to FIG. 5, the engaging projections 7 and the engaging recesses 6 of one floating unit are engaged to the engaging recesses 6 and the engaging projections 7 of another floating unit respectively, while lock-connecting elements 36 of the lock are snugly engaged to the corresponding upper and lower engaging surface (200 and 202) (not shown), so that the floating units can be locked together. An external device installing channel 300 formed after this assembly is in the form of a substantially circular shape located in the middle of the floating structure.

FIG. 6 shows the fifth embodiment of the floating unit according to this invention, wherein the same parts are referred to by the same reference numbers, and they will not be repeatedly described.

According to FIG. 6, another structure of the hollow hexagonal prism-shaped floating unit for facilitating lock-connecting of an external device is shown. The floating unit has the structure for facilitating assembly between the floating units and assembly with the external connecting device on both horizontal and vertical directions. At least one of all six lateral surfaces of the hollow hexagonal prism-shaped floating unit may be provided with a main concave portion 1 or a recess being in the form of a concave portion having a certain width and extended between the upper engaging surface to the lower engaging surface. The respective regions of the upper and lower surface of the floating unit located adjacent to the main concave portion 1 are provided with the engaging surfaces comprising notches 16 having a certain width and depth. The notch 16 is depressed to a portion 17 and inwardly and upwardly widened to the respective corners 18 in order to form the structure capable of being engaged to the device required to be engaged thereto.

According to FIG. 6A, at least one of either side of the hollow hexagonal prism-shaped floating unit is provided with at least one engaging recess 6 having a certain width and the length fully extended along the side from the upper engaging surface to the lower engaging surface, so that the engaging projection of another floating unit required to be attached thereto can be engaged to this recess. Likewise, at least one of either side of the hollow right isosceles triangular prism-shaped floating unit is provided with at least one engaging projection 7 having a certain width and curvature, and the length fully extended along the lateral surface between the upper engaging surface and the lower engaging surface, so that the engaging recess 6 of another floating unit required to be attached thereto can be engaged to this projection.

FIG. 6B is the top plan view of the hexagonal floating unit according to this embodiment. FIG. 6C is an enlarged view of the engaging surface of the floating unit.

According to FIG. 6B, the respective regions of the upper and lower surface of the hollow hexagonal prism-shaped floating unit may be provided with an anti-slip groove pattern (not shown in this figure). The respective regions of the upper and lower surface of the floating unit are provided with at least one hole 8 having a certain diameter and depth, and not penetrated into the inside, wherein the holes may be spaced apart with the certain distance. The hole 8 serves as a hole for filling a material into the floating unit, and then the hole is closed, so that the floating unit is submerged in water as required. Furthermore, the hole can serve as a hole for filling air in order to expel liquid (water) out of the floating unit, so that the submerged floating unit can be lifted up.

FIG. 7 shows an example of a process for assembly the floating units according to FIG. 6 in order to construct a single-floor floating structure.

FIGS. 8A-8C show the sixth embodiment of the floating unit according to this invention, wherein the same parts are referred to by the same reference numbers, and they will not be repeatedly described.

According to FIG. 8, another structure of the hollow rectangular prism-shaped floating unit for facilitating lock-connecting of an external device is shown. The floating unit has the structure for facilitating assembly between the floating units and assembly with the external connecting device on both horizontal and vertical directions. The respective right-angle corner of the rectangular prism-shaped floating unit may be provided with a main concave portion 9 or a recess being in the form of a concave portion having a certain width and curvature at the right-angle corner, or it can be a beveled portion at this corner fully extended between the upper engaging surface and the lower engaging surface. The respective regions of the upper and lower surface of the floating unit located adjacent to the main concave portion 9 are provided with curved ridges 19 each of which has a certain width and length corresponding to the curved edge of the main concave portion 9, and the level of the top portion of the curved ridge 19 is not reached to that of the upper surface, and the level of the bottom portion of the curved ridge is also not reached to that of the lower surface.

According to FIGS. 8B and 8C, the region of the engaging surface 200 located adjacent to the curved ridge 19 has a peripheral groove 20. The peripheral groove 20 has the certain width and depth, and both ends of the peripheral groove 20 are terminated at the respective adjacent sides of the right-angle corner.

According to FIG. 8C, at least one side of all four lateral surfaces of the hollow rectangular prism-shaped floating unit may be provided with a main concave portion 1 or a recess being in the form of a concave portion having a certain width and curvature, and the length fully extended along the height of the lateral surface, such that the upper portion is located next to the upper surface, and the lower portion is also located next to the lower surface. The respective regions of the upper and lower portion of the main concave portion 1 have curved ridges 19 located next to the main concave portion 1. The curved ridge 19 has a certain width and length corresponding to the curved edge of the main concave portion 1, wherein the level of the top portion of the curved ridge 19 is not reached to that of the upper surface, and the level of the bottom portion of the curved ridge is also not reached to that of the lower surface. The respective regions located next to the corresponding curved ridges 19 have the peripheral groove 20 each of which has a certain width and depth, and both ends of the peripheral groove 20 are terminated at the respective left and right sides on the corresponding same side of the floating unit.

According to FIG. 8, at least one of either side of the hollow rectangular prism-shaped floating unit is provided with at least one engaging recess 6 having a certain width and the length fully extended along the side from the upper engaging surface to the lower engaging surface, so that the engaging projection of another floating unit required to be attached thereto can be engaged to this recess. Likewise, at least one of either side of the hollow right isosceles triangular prism-shaped floating unit is provided with at least one engaging projection 7 having a certain width and curvature, and the length fully extended along the lateral surface between the upper engaging surface and the lower engaging surface, so that the engaging recess 6 of another floating unit required to be attached thereto can be engaged to this projection.

The respective regions of the upper and lower surface of the hollow rectangular prism-shaped floating unit may be provided with an anti-slip groove pattern, or an anti-slip layer (not shown in this figure). The respective regions of the upper and lower surface of the floating unit are also provided with at least one hole 8 having a certain diameter and depth, and not penetrated into the inside, wherein the holes may be spaced apart with a certain distance. The hole 8 serves as a hole for filling a material into the floating unit, and then the hole is closed, so that the floating unit is submerged in water as required. Furthermore, the hole can serve as a hole for filling air in order to expel liquid (water) out of the floating unit, so that the submerged floating unit can be lifted up.

Figure 9:
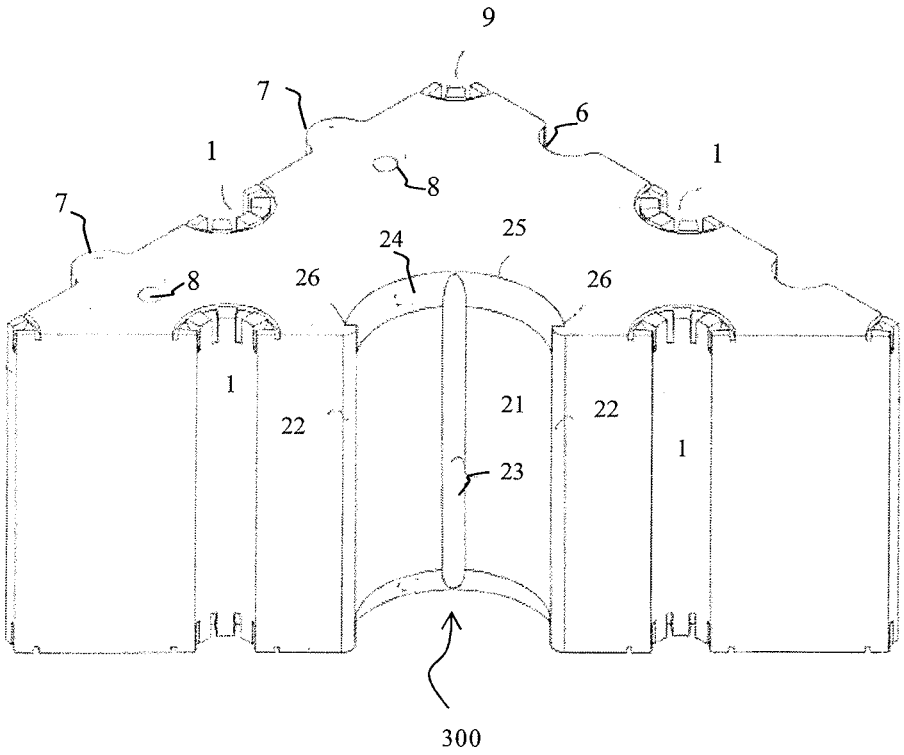
FIG. 9 shows a structure of the floating unit according to the forth embodiment as shown in FIG. 4 for facilitating assembly with another floating unit or assembly with an external device.

FIG. 9 shows another structure of the floating unit according to the fourth embodiment as shown in FIG. 4 for facilitating assembly with another floating unit or assembly with an external device, wherein the same parts are referred to by the same reference numbers, and they will not be repeatedly described.

FIG. 9 shows the structure of the floating unit for facilitating assembly with another floating unit or assembly with the external device. The floating unit according to the fourth embodiment as shown in FIG. 4 is the hollow right isosceles triangular prism-shaped floating unit having the structure for facilitating assembly between floating units and assembly with the external connecting device on both horizontal and vertical directions as previously described.

A general-purpose channel used for installing the external device such as a post, a pipe or the likes is described hereafter.

According to FIG. 9, the region of the hypotenuse of the triangular floating unit may be provided with a concave portion 21 having a certain width and curvature, and the length fully extended along the height of the hypotenuse of the triangular floating unit from the upper engaging surface to the lower engaging surface. Both left and right sides of the concave portion 21 are respectively provided with a curved beveled shoulder 22 having a certain curvature and width, and the length fully extended along the height of the hypotenuse of the triangular floating unit from the upper engaging surface to the lower engaging surface. At least one recess 23 may be formed inside the concave portion 21, wherein the recess 23 has a certain curvature and width, and the length fully extended along the length of the concave portion 21. The respective regions of the upper and lower surfaces located adjacent to the concave portion 21 are provided with widening inclined indentations 24 each of which is upwardly widened to a stop edge 25 of the upper and lower surfaces respectively. The stop edge 25 has a certain curvature, width, and length, and it is terminated at the respective left and right edge corners 26. The length of the stop edge 25 between the edge corners 26 is more than that of the indentation 24 located adjacent to the concave portion 21. The widening inclined indentation 24 is also partially intersected with the upper and lower portions of the recess 23. The widening inclined indentation 24 is served as a lock for locking and engaging an auxiliary floating unit required to be engaged and locked thereto. Furthermore, the lower surface is identical to the upper surface and appears to be a mirror image of the upper surface.

Figure 10:
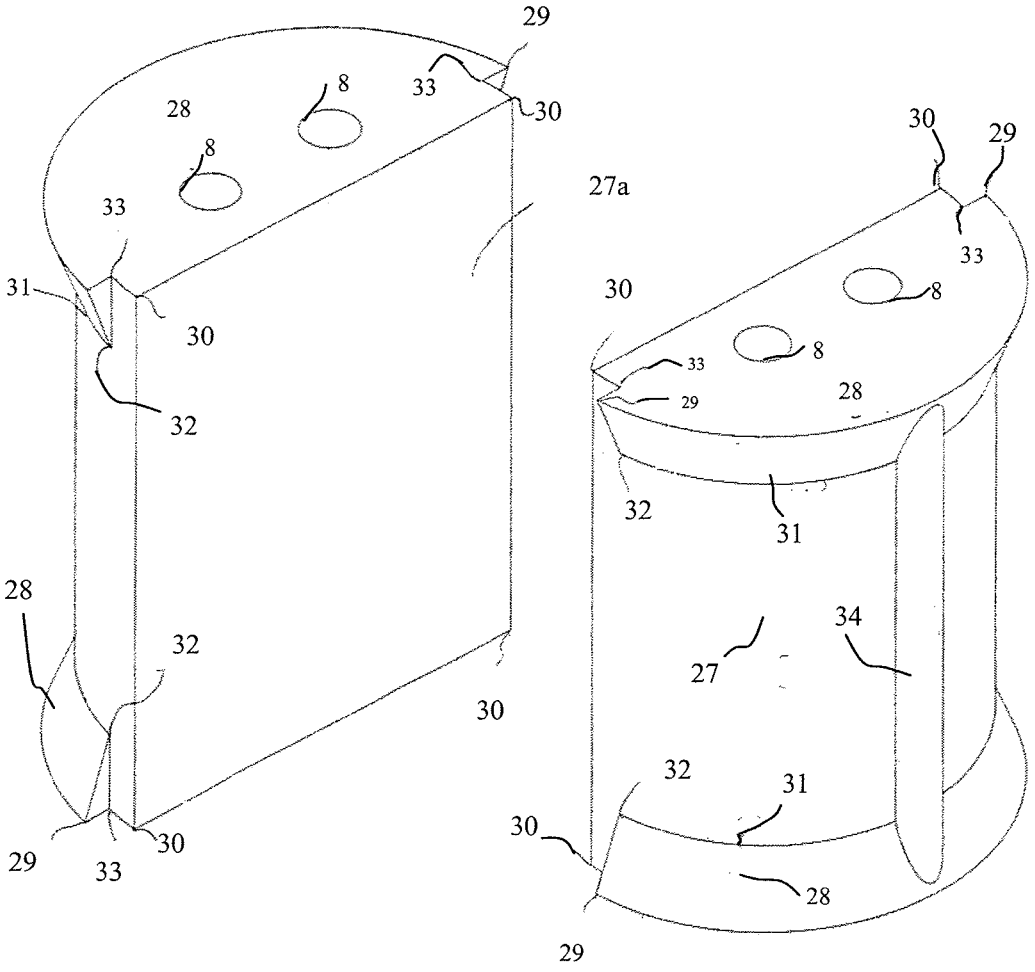
FIG. 10 shows a detail of an auxiliary floating unit used in combination with the structure for facilitating assembly between floating units or assembly with the external connecting device such as a water pipe, an electric conduit, etc.

FIG. 10 shows detail of the auxiliary floating unit used in combination with the structure for facilitating assembly between floating units or assembly with the external connecting device such as a water pipe, an electric conduit, etc.

According the FIG. 10, the auxiliary floating unit 27 is in the form of two half-cylindrical pieces. The half-cylindrical piece 27 is hollow, and has a certain diameter, width and length, wherein the upper portion is located next to the upper surface, and the lower portion is also located next to the lower surface. The respective upper and lower surfaces are provided with a wing 28 having a certain width, curvature, and length, and extended to the left and right edge corners 29 on both upper and lower portions. The wing 28 is projected from the outside of the half-cylindrical piece 27, but the edge corners 29 of the wing 28 is extended such that it is not reached to the edge corner 30 at the half-cut line of the cylindrical floating unit on both upper and lower portions. Both left and right edge corners 29 of the wing extended through the wing 28 are respectively inclined toward and reached the outside of the auxiliary floating unit 27 at the corresponding edge line 31, and both edge corners 29 are respectively inclined toward the left and right edge corners 32 at the outside of the auxiliary floating unit 27 on the upper and lower portions. The respective edge corners 32 are not reached to the half-cut line of the cylindrical floating unit. The edge corner 29 is extended to the edge corner 33 on the upper and lower surfaces of the auxiliary floating unit 27 in both left and right sides of the upper and lower portions, such that a gap is formed between the edge corner 30 and the edge corner 33 having a certain distance. The outside of the auxiliary floating unit 27 is provided with a convex projection 34 having a certain width and curvature, and the length extended fully along the lateral side of the auxiliary floating unit 27, such that the upper and lower portions of the convex projection is extended partially into the wing 28. The auxiliary floating unit 27 is engaged to the concave portion 21 of the right isosceles triangular prism-shaped floating unit according to FIG. 9 as disclosed in the detailed description, such that, at the same time, the wing 28 of the auxiliary floating unit 27 is fitted with the widening inclined indentation 24 of the floating unit according to FIG. 9, and the left and right edge corners 26 of the widening inclined indentation 24 on both upper and lower portions according to FIG. 9 are respectively locked onto the gap formed between the edge corner 30 and the edge corner 33 of the auxiliary floating unit 27, and the convex projections 34 or the convex wedge of the auxiliary floating unit 27 are respectively fitted with the concave portion 23 according to FIG. 9.

The respective regions of the upper and lower surface of the floating unit are provided with at least one hole 8 having a certain diameter and depth, and not penetrated into the inside, wherein the holes may be spaced apart a the certain distance. The hole 8 serves as a hole for filling a material into the floating unit, and then the hole is closed, so that the floating unit is submerged in water as required. Furthermore, the hole can serve as a hole for filling air in order to expel liquid (water) out of the floating unit, so that the submerged floating unit can be lifted up.

The flat inner surface of the half-cylindrical pieces 27*a* can be corrugated or has reinforcing fins for reinforcement. The respective regions of the upper and lower surface of the hollow rectangular prism-shaped floating unit may be provided with an anti-slip groove pattern (not shown in this figure). The respective regions of the upper and lower surface of the floating unit are provided with at least one hole 8 having a certain diameter and depth, and not penetrated into the inside, wherein the holes may be spaced apart a the certain distance. The hole 8 serves as a hole for filling a material into the floating unit, and then the hole is closed, so that the floating unit is submerged in water as required. Furthermore, the hole can serve as a hole for filling air in order to expel liquid (water) out of the floating unit, so that the submerged floating unit can be lifted up.

Figure 11:
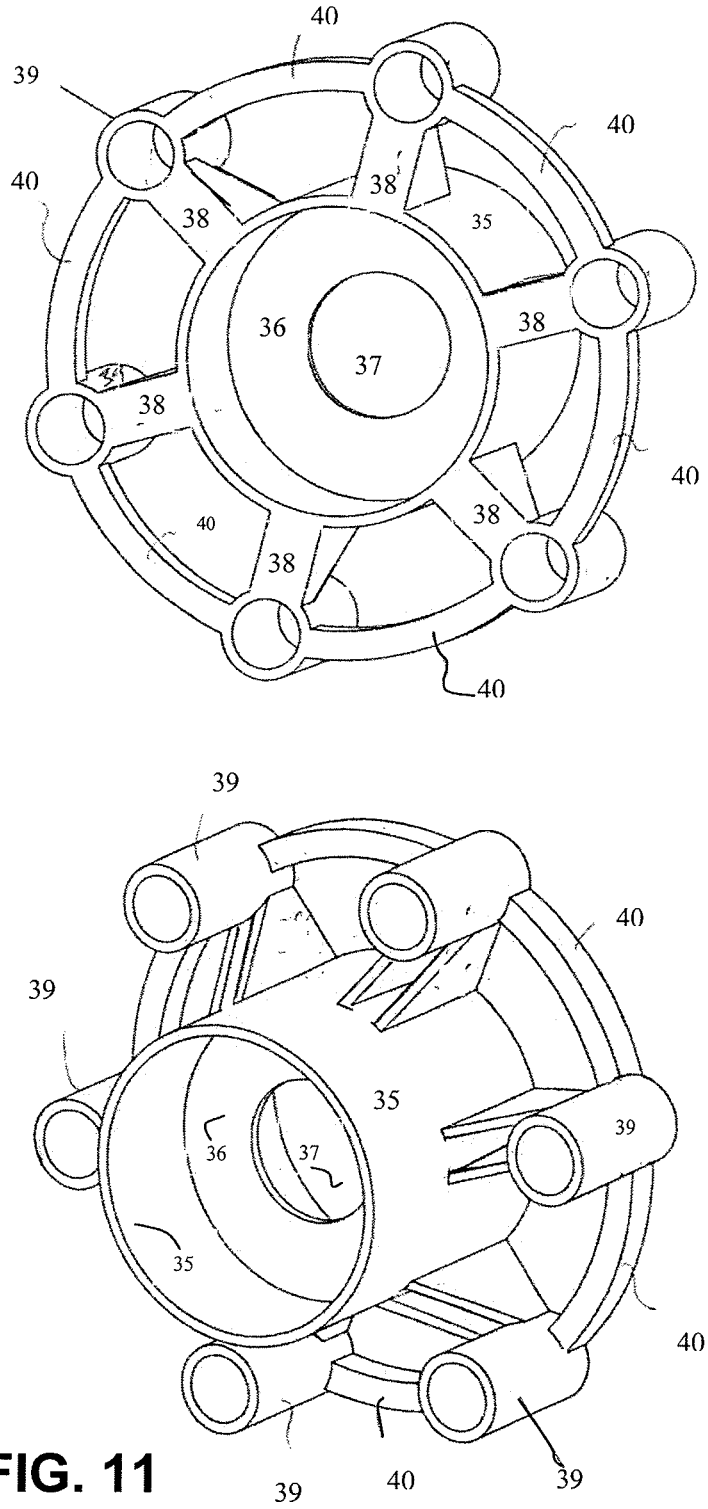
FIG. 11 shows one form of a main lock-connecting element of the lock served as the element engaged to the engaging surface of the floating unit according to the first embodiment as shown in FIG. 1.

FIG. 11 shows one form of the Main lock-connecting element of the lock served as the element engaged to the engaging surface of the floating unit according to the first embodiment as shown in FIG. 1, wherein the same parts are referred to by the same reference numbers, and they will not be repeatedly described.

According to FIG. 11, the main locking shaft 35 is shown as viewed from above and below. The main locking shaft 35 is in the form of a hollow cylindrical element having a certain diameter and length, and has a base 36 formed at the certain depth inside the main locking shaft 35. The base 36 has a hole 37 having a certain diameter, and penetrated into the inside, and the base 36 can also be flush with the upper edge of the main locking shaft 35. The outside of the main locking shaft 35 is provided with portions 38 each of which has a certain width, length and height, wherein the two (or at least one) portions 38 are connected to the outside of the main locking shaft 35 and periodically spaced apart with a certain distance along the outside of the main locking shaft 35. The respective ends of the portions 38 are connected to the upper edge of the main locking shaft 35 and the respective other ends of the portion 38 are connected to the respective portions 39. The portion 39 is a hollow cylindrical portion having a certain diameter, width and length, and the portion 39 can also be in the form of the portion with an elliptical cross-section or other cross-section shape, and the upper portion of the portion 39 can be closed. The height of the portion 38 located next to the portion 39 is less than that of the portion 38 locate next to the outside of the main locking shaft 35, such that the portion 38 connected to the main locking shaft 35 at the lower part of the upper edge is inclined toward the portion 39.

A curved portion 40 may be arranged between two portions 39, and the curved portion 40 has a certain width and thickness, and the length corresponding to the distance between two portions 39, wherein each curved portion connects two portions 39 together all existing portions 39, such that the portions 39 are connected together by the curved portions and formed into a circle loop. The main locking shaft 35 is the lock-connecting element for the engaging structure of the floating unit according to FIG. 1.

Figure 12:
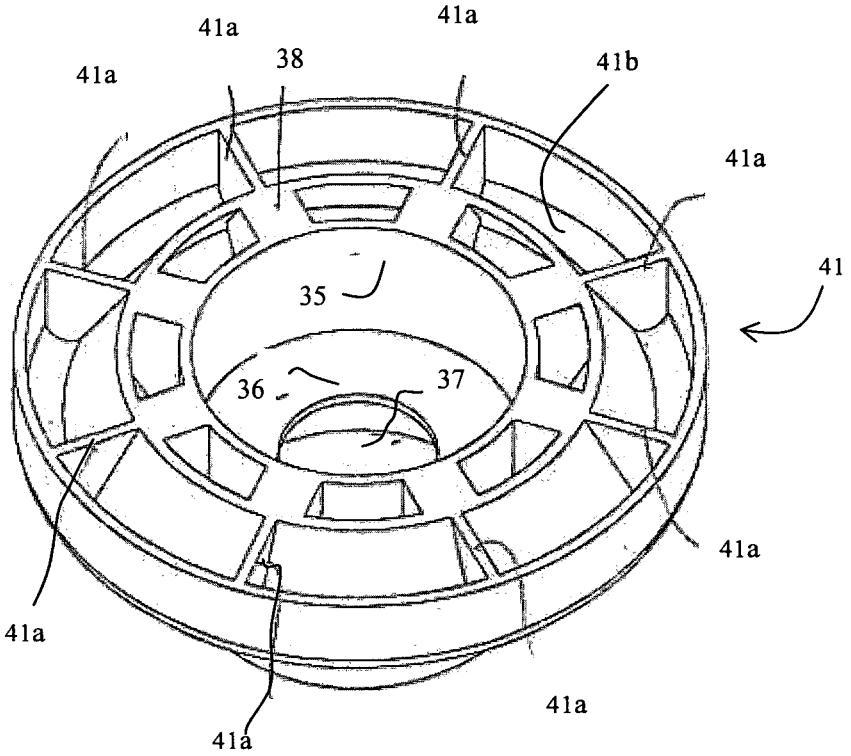
FIG. 12 shows another form of the main lock-connecting element of the lock served as the element engaged to the engaging surface of the floating unit according to the second embodiment as shown in FIG. 2.

FIG. 12 shows another form of the main lock-connecting element of the lock served as the element engaged to the engaging surface of the floating unit according to the second embodiment as shown in FIG. 2, wherein the same parts are referred to by the same reference numbers, and they will not be repeatedly described.

According to FIG. 12, a main locking shaft 41 as viewed from below is in the form of a hollow cylindrical element having a certain diameter and length, and has a base 36 formed at a certain depth inside the main locking shaft 35. The base 36 has a hole 37 having a certain diameter, and penetrated into the inside, and the base 36 may be flush with the upper edge of the main locking shaft 35. The outside of the main locking shaft 35 is provided with portions 38 each of which has a certain width, length and height, wherein the two (or at least one) portions 38 are connected to the outside of the main locking shaft 35 and periodically spaced apart with a certain distance along the outside of the main locking shaft 35. The respective ends of the portions 38 are connected to the upper edge of the main locking shaft 35, and the respective other ends of all portions 38 are connected to an annular compartment portion 41, wherein the annular compartment portion 41 is in the form of a hollow annular portion having a certain width, and cut in half in order to obtain the annular compartment portion 41 having a base 41*b* at the certain depth, wherein the annular compartment portion is flush with the portions 38. The height of the portion 38 located next to the annular compartment portion 41 is less than that of the portion 38 locate next to the main locking shaft 35, such that the portion 38 connected to the main locking shaft 35 at the lower part of the upper edge is inclined toward the annular compartment portion 41. The inside of the annular compartment portion 41 is provided with at least one or a plurality of portions 41*a*, wherein the portion 41*a* has the certain width and length corresponding to the inside of the annular compartment portion 41, and the respective portions 41*a* are connected to the inner surface of the compartment of the annular compartment portion 41. The respective portions 38 are inserted into the corresponding grooves 2 and fitted with the corresponding peripheral grooves 10 of the upper and lower engaging surface 200 and 202 (FIG. 2) according to the second embodiment, so that the lock-connecting element is fastened to the engaging surfaces of the floating units.

Figure 13:
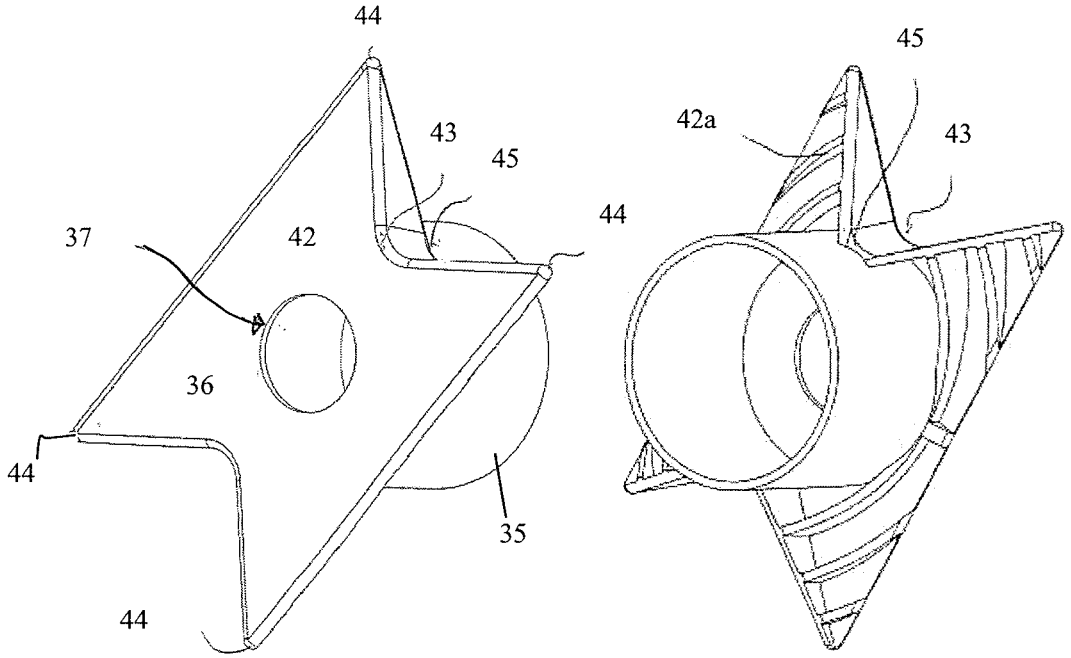
FIGS. 13A, 13B 14A, and 14B show another form of the main lock-connecting element of the lock served as the element engaged to the engaging surface of the floating unit according to the third embodiment as shown in FIG. 3.
Figure 14:
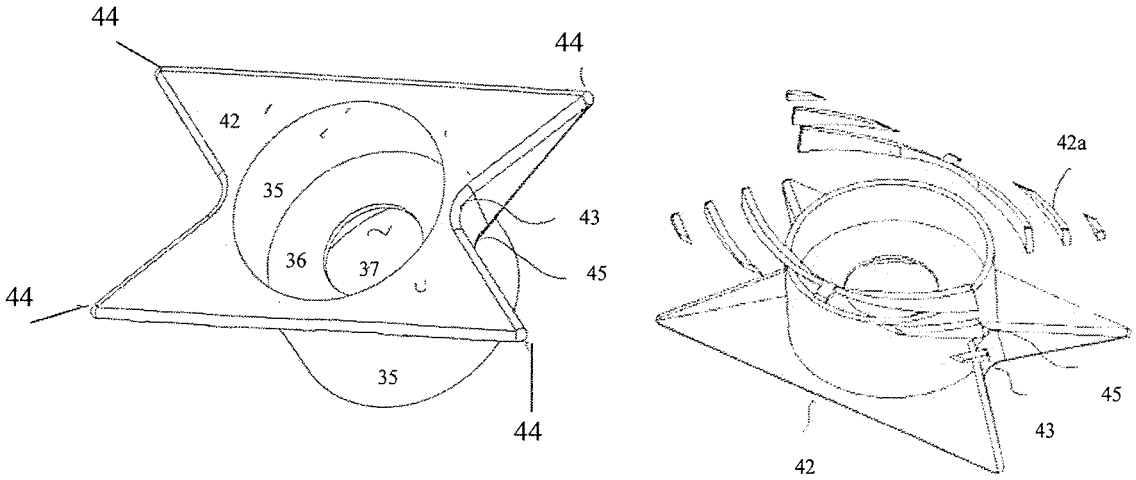

FIGS. 13 and 14 show another form of the main lock-connecting element of the lock served as the element engaged to the engaging surface of the floating unit according to the third embodiment as shown in FIG. 3, wherein the same parts are referred to by the same reference numbers, and they will not be repeatedly described.

According to FIGS. 13A and 13B, a wing-type locking shaft 42 is shown as viewed from the first side and the second side respectively. According to FIGS. 14A and 14B, the other form of the wing-type locking shaft 42 is shown as viewed for the first side and the second side respectively.

The wing-type locking shaft 42 has a main locking shaft 35, wherein the main locking shaft is in the form of a hollow cylindrical element having a certain diameter and length, and a base 36 is formed at the certain depth inside the main locking shaft 35 (as shown in FIG. 14A). The base 36 has a hole 37 having a certain diameter, and penetrated into the inside as shown in FIG. 13A, and the base 36 can also be flush with the upper edge of the main locking shaft 35. A wing 42 is projected and widened from the upper edge of the main locking shaft 35 to the left and right corners 44, wherein the left and right edges of the wing 42 are respectively formed into the V shape, such that the edge are widened from the edge corner 43 located at the middle of the wing 42 and on the bottom portion of the "V" shape along the leg portion of the "V" shape to the respective corners 44, so that the wing width between corners 44 (not V-shaped portion) is more than that between edge corners 43 (V-shaped portion); and wherein the inclined edge is formed from the corner 44 to the corner 45 located next to the outside of the main locking shaft 35, the wing thickness is formed from the corner 45 to the corner 43, such that the triangular walls located at the level lower than that of the wing 42 for all four corners are formed by the corner 43, 44, and 45 being vertices of the triangular wall, so that the wing-type locking shaft 42 is obtained.

According to FIG. 13B, pieces 42*a* are arranged underneath the wing 42 and served as reinforcing pieces according to FIG. 13B. A plurality of the reinforcing pieces 42*a* respectively have a certain width and length according to FIG. 14(B), and are being connected to the wing 42 from underneath.

Furthermore, all of the reinforcing pieces 42*a* according to FIG. 13(B) are already installed to the wing 42 from underneath, wherein the wing-type locking shaft 42 is served as the lock-connecting element associated to the engaging structure of the floating unit according FIG. 3.

Figure 15:
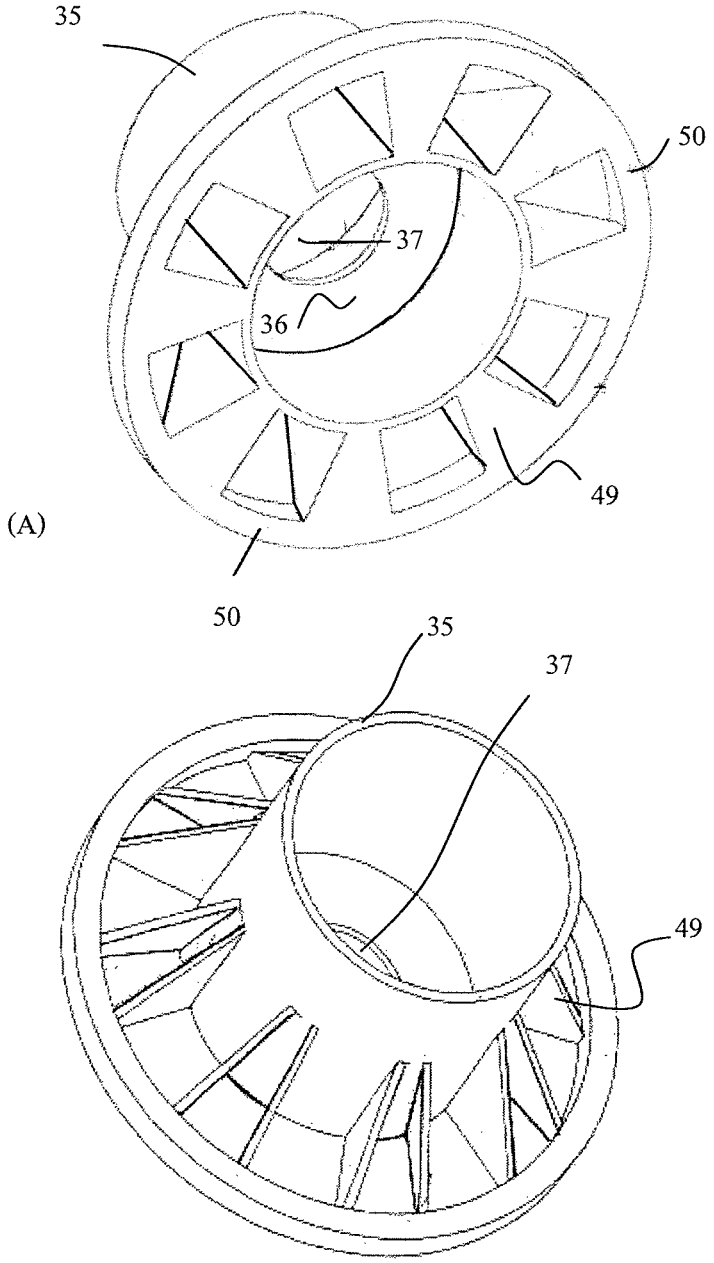
FIG. 15 shows another form of the main lock-connecting element of the lock served as the element engaged to the engaging surface of the floating unit according to the forth embodiment as shown in FIG. 4.

FIG. 15 shows another form of the main lock-connecting element of the lock as viewed from above and below served as the element engaged to the engaging surface of the floating unit according to the fourth embodiment as shown in FIG. 4, wherein the same parts are referred to by the same reference numbers, and they will not be repeatedly described.

FIGS. 15A and 15B show a widening inclined locking shaft 50 as viewed from above and below respectively. The locking shaft 50 has main locking shaft 35 being in the form of a hollow cylindrical element having a certain diameter and length, and a base 36 formed at the certain depth inside the main locking shaft 35. The base 36 has a hole 37 having a certain diameter, and penetrated into the inside, and the base 36 can also be flush with the upper edge of the main locking shaft 35. The outside of the main locking shaft 35 is provided with portions 49 each of which has a certain width, length and height, such that they can respectively be fitly engaged to the widening inclined indentation 14 according to FIG. 4. The respective ends of the portions 49 are connected to the upper edge of the main locking shaft 35, and the respective other ends of all portions 49 are connected to an annular portion 50 at the level of the upper edge of the main locking shaft 35, like the portion 49. The annular portion 50 is in the form of an annular portion having a certain width and thickness. The width of the portion 49 located next to the annular portion 50 is more than that of the portion 49 located next to the main locking shaft 35, and the height of the portion 49 located next to the annular portion 50 is less than that of the portion 49 located next to the main locking shaft 35, such that the portions 49 connected to the main locking shaft 35 at the lower part of the upper edge is widened and inclined toward the annular portion 50. Therefore, the widening inclined locking shaft 50 is the lock-connecting element associated to the engaging structure of the floating unit according FIG. 4.

FIG. 16 shows another form of the main lock-connecting element of the lock served as the element engaged to the engaging surface of the floating unit according to the fifth embodiment as shown in FIG. 6, wherein the same parts are referred to by the same reference numbers, and they will not be repeatedly described.

According to FIG. 16, a wing-type locking shaft 46 is shown. The wing-type locking shaft 46 has a main locking shaft 35, wherein the main locking shaft is in the form of a hollow cylindrical element having a certain diameter and length, and a base 36 is formed at the certain depth inside the main locking shaft 35. The base 36 has a hole 37 having a certain diameter, and penetrated into the inside, and the base 36 can also be flush with the upper edge of the main locking shaft 35. At the upper edge level of the main locking shaft 35, wings 46 are projected and widened from both sides of the upper edge of the main locking shaft 35 at the same level as the upper edge of the main locking shaft 35, such that the wing is widened to the respective corners 47 on both sides, so that the wing width between corners 47 is more than that of the wing located next to the outside of the main locking shaft 35, and the lower portion of the wing is in the form of a curved surface similar to a quarter-sphere, such that the hollow quarter sphere is connected to the main locking shaft 35 served as the main structure and a point 48 is the lowest point of the curved surface, so that both wings have respectively the curved surface pointed downward.

According to FIG. 16, the wing 46 may preferably be provided with a reinforcing piece 48*a* for reinforcement. At least one reinforcing piece 48*a* having a certain width, height and length is arranged inside the quarter-sphere for reinforcement of the wing 46.

The wing-type locking shaft 46 is the locking component associated to the engaging structure of the floating unit according FIG. 6 as shown in the way of an example of the floating structure in FIG. 7.

FIG. 17 shows another form of the main lock-connecting element of the lock served as the element engaged to the engaging surface of the floating unit according to the sixth embodiment as shown in FIG. 6, wherein the same parts are referred to by the same reference numbers, and they will not be repeatedly described.

According to FIG. 17, a lock-connecting element 46*a* has the similar feature to the lock-connecting element 46 as shown in FIG. 16. However, the main locking shaft 35*a* which is the main structure is different therefrom, and the main locking shaft has a hexagonal shape. The other portions are the same, so that they are not repeatedly described.

FIG. 18 shows the seventh embodiment of the floating unit according to this invention used with the main lock-connecting element as shown in FIG. 17.

According to FIG. 18, the top plan view of a surface 101 of the floating body is shown which is similar to that of FIG. 6B. However, the main concave portion 1*a* has the shape which is one section a hexagonal shape, such that when this floating unit is assembled to another floating unit, the hexagonal shape is obtained, so that the lock-connecting element 46*a* can be snugly engaged therein.

FIGS. 19A and 19B show another form of the main lock-connecting element of the lock as viewed from above and below served as the element engaged to the engaging surface of the floating unit according to the sixth embodiment as shown in FIG. 8, wherein the same parts are referred to by the same reference numbers, and they will not be repeatedly described.

A lock-connecting element 36 comprises a through hole 37 in the middle adapted for inserting of the locking rod 55 through said through hole 37, wherein the lock-connecting element 36 comprises an engaging surface which can be snugly engaged to the upper engaging surface 200 or the lower engaging surface 202 of said floating unit.

Furthermore, the lock-connecting element has a main locking shaft 35 being in the form of a hollow cylindrical shaft with a certain diameter. A base 36 is formed at the certain depth inside the main locking shaft 35. The base 36 has the hole 37 having a certain diameter, and penetrated into the inside, and the base 36 can also be flush with the upper edge of the main locking shaft 35 at the curved edge of the main locking shaft 35.

For this embodiment, the engaging surface of this lock-connecting element comprises a curved rim 51 connected to the main locking shaft 35, and an annular indentation 52 located adjacent to the curved rim 51, wherein the annular indentation 52 has a rim 54 having the height approximately equal to that of the rim 51, and the rim 51 is obliquely extended and connected to the main locking shaft 35 which is corresponding to the inside surface of the groove 20 and the wall of the ridge 19 of the engaging surface of the floating body according to the sixth embodiment as shown in FIG. 8, so that they can be snugly engaged.

According to FIG. 19, the detail of the locking shaft 52 is shown, wherein the locking shaft 52 has a main locking shaft 35, wherein the main locking shaft is in the form of a hollow cylindrical shaft having a certain diameter, and a base 36 formed at the certain depth inside the main locking shaft 35. The base 36 has a hole 37 having a certain diameter, and penetrated into the inside. The upper edge region of the main locking shaft 35 is provided with the curved rim 51, wherein the curved rim 51 has a certain width and length, and is extended throughout the curved upper edge of the main locking shaft 35. The annular indentation 52 is located adjacent to the curved rim 51, wherein the annular indentation 52 is arranged next to the curved rim 51, and the annular indentation 52 has the certain depth obtained by the base 53, such that the depth of the annular indentation 52 is determined by the base 53. A surface 54 is formed at the outer upper edge of the annular indentation 52, wherein the surface 54 is the curved upper edge of the annular indentation 52 and is flush with the curved rim 51. The inside of the annular indentation 52 is provided with at least one or a plurality of pieces 51*a*, wherein the piece 51*a* has a certain width and length corresponding to the inside of the annular indentation 52, and the pieces 51*a* are connected to the inner surface of the annular indentation 52.

FIG. 20 shows detail of the lock comprising a locking rod, an inner lock-inserting element, a locking element, and a lock-inserting element.

According to FIG. 20A, the lock-connecting element (according to FIG. 13), the locking rod 55, the inner lock-inserting element 59, the locking element, and the lock-inserting element are shown.

According to FIG. 20, the locking rod 55 is in the form of a hollow cylindrical rod having at least two holes 58 penetrated through the wall of said locking rod 55, and the holes 58 are located on said locking rod 55 at the level according to the desired height of the floor of the structure.

The lock-connecting element is comprises a central through hole adapted for snugly inserting of said locking rod 55 therethrough, wherein said locking-connecting element comprises the engaging surfaces capable of fitted engaging to the upper engaging surface 200 or the lower engaging surface 202 of said floating unit (not shown).

According to FIG. 20B, a pair of the lock-engaging element 63 is shown, wherein each lock-engaging element 63 is in the form of an arc-shaped portion capable of snugly enclosing the outside of the locking rod 55, and the inside of each lock-engaging element 63 is provided with at least one latch 65 for snugly inserting into the corresponding hole 58 of the locking rod 55, while said pair of lock-engaging elements 63 is enclosed the outside of the locking rod 55.

The lock-inserting element 59 is put on and covered on the end of the locking rod 55 enclosed by the pair of said lock-engaging elements 63, wherein, in use, an edge of each lock-engaging element 63 is abutted on the corresponding lock-connecting element 36, such that the engaging surface of said lock-connecting element 36 is locked, onto said corresponding upper or lower engaging surfaces 200 or 202 of at least two floating units together, whereby the floating units can be locked and attached together, and the floating structure can be constructed therefrom as shown in a way of an example in FIGS. 5 and 7. The detail of the assembly procedure will be described later.

According to FIG. 20, the elements 55, 59, 63, and 67, which are external lock-inserting device, are show. The locking rod 55 is in the form of a cylindrical rod having a certain diameter, wherein the rod has a through hole 56 extended longitudinally along the rod, and a rod wall 57 has a certain thickness. The locking rod 55 is provided with holes 58 having a certain width and length, and periodically spaced apart along the length of the locking rod 55. FIG. 20 also shows the inner lock-inserting element 59 being in the form of a hollow cylindrical shaft having a certain diameter, wherein the inner lock-inserting element comprises a shoulder 60 projected from one end, at least one protrusion 61 having a certain width and projected distance and the length fully extended longitudinally along the lock-inserting element 59, and at least one button 62 projected inwardly.

Said lock-engaging element 63 also comprises at least one through hole 66 on the its side. Said lock may further comprises a lock-inserting element 67 shaped in order to be snugly put on and covered the hole 56 of the locking rod 55. The lock-inserting element has a protrusion 69 for inserting into said through hole 66 of said lock-engaging element 63, so that they can be fastened together.

The protrusion 69 of the lock-inserting element 67 may be further provided with a concave groove 70 used for positioning, and said lock-inserting element 59 may be further provided with a button 62 for position determination, wherein, in use, said button 62 of said lock-inserting element 59 is fitted into the concave groove 70 of said protrusion 69 of said lock-inserting element 67.

According to FIG. 20, the locking element 63 is in the form of an arc-shaped portion, wherein the inner surface of the arc-shaped portion 63 has a certain curvature in order to be snugly engaged to the outside of the locking rod 55. The locking element 63 has a certain thickness and height, wherein a flange 64 having a certain width served as a shoulder and extended throughout the arc-shaped portion 63 is provided at one end; and at least one latch 65 having a certain width, length and thickness in order to be fitted into the hole 58 of the locking rod 55 is projected from the inner surface of the arc-shaped portion 63. The wall of the locking element 63 is also provided with a through hole 66. The locking elements 63 are used in pairs for locking onto the holes 58 in pairs of the locking rod 55.

According to FIG. 20, the lock-inserting element 67 is shown, wherein the lock-inserting element is in the form of a cylindrical shaft having the certain diameter equal to that of the locking rod 55, and a certain length. The lock-inserting element has a through hole 68 wherein the hole may be provided with female threads. One end of the lock-inserting element 67 is smaller than the other end, which has a certain length and diameter, such that it can be inserted into the hole 56 of the locking rod 55, so that the lock-inserting element 67 can be snugly seated on the wall 57 of the locking rod 55. The outside of the lock-inserting element 67 is provided with at least one protrusion 69 having a projected length not more than the wall thickness of the locking element 63, and the proper size in order to be fitted into the through hole 66 of the locking element 63, and the concave groove 70 having the proper width and depth in order to be locked onto the button 62 of the lock-inserting element 59.

FIGS. 21A-21E show steps of assembling the lock as shown in FIG. 20, wherein the same parts are referred to by the same reference numbers, and they will not be repeatedly described.

Figure 21:
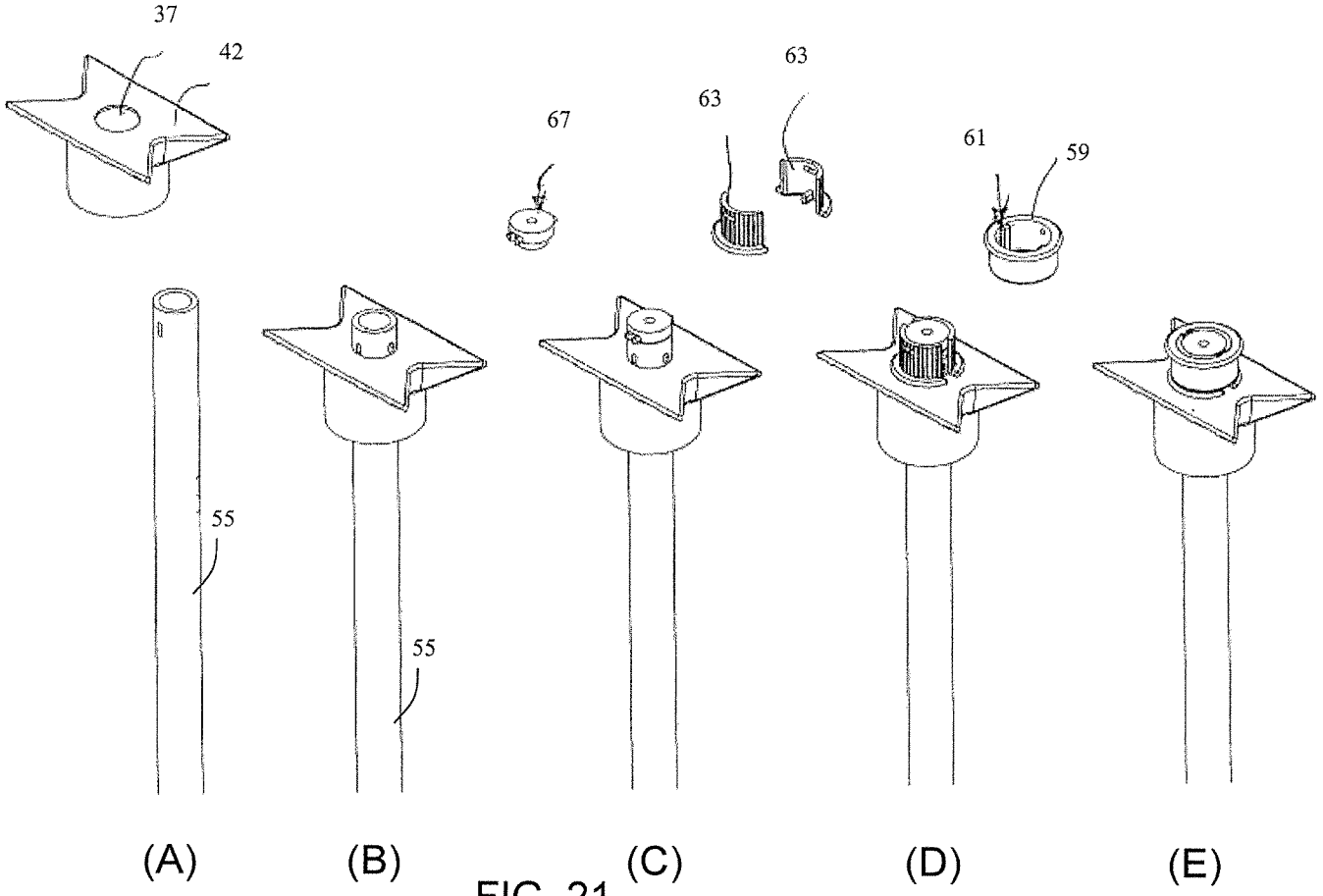
FIGS. 21A-21E show steps of assembling the lock as shown in FIG. 20.

According to FIG. 21, an example of the assembly method of the locking rod 55 according to FIG. 20 in order to lock onto the wing-type locking shaft 42 according to FIG. 13 is shown.

According to FIG. 21A, the wing-type locking shaft 42 is shown, wherein the locking rod 55 is inserted into the hole 37 of the wing-type locking shaft 42.

According to FIG. 21B, the locking rod 55 is already inserted into the hole 37 of the wing-type locking shaft 42. According to FIG. 21C, the lock-inserting element 67 is put on the hole 56 of the locking rod 55. According to FIG. 211), the latches 65 of the locking element 63 are respectively inserted into both holes 58 of the locking rod 55.

According to FIG. 21E, the protrusions 61 of the inner lock-inserting element are respectively inserted into the gaps between the arc-shaped portions 63, while the buttons 62 are respectively locked onto holes 66 of both left and right arc-shaped portions 63, and respectively put on the grooves 70 and then fitted into the grooves 70 in order to be locked onto the locking rod 55. At the same time, the through holes 66 are respectively locked onto both protrusions 69, and the protrusions 61 of the lock-inserting element 59 are respectively snugly inserted into the gaps formed between the arc-shaped portions 63, and the buttons 62 is respectively snugly inserted into the holes 66 of the locking element 63, so that the lock-inserting element 59 is locked onto both locking elements 63, and the buttons 62 is respectively forcibly locked onto the holes 66 and grooves 70.

At any rate, the locking rod 55 should be made of a rigid material such as stainless steel, or a strong plastic such as polyester, high density PPE, etc., or the likes, such that the rod can support the whole load and structure.

Figure 22:
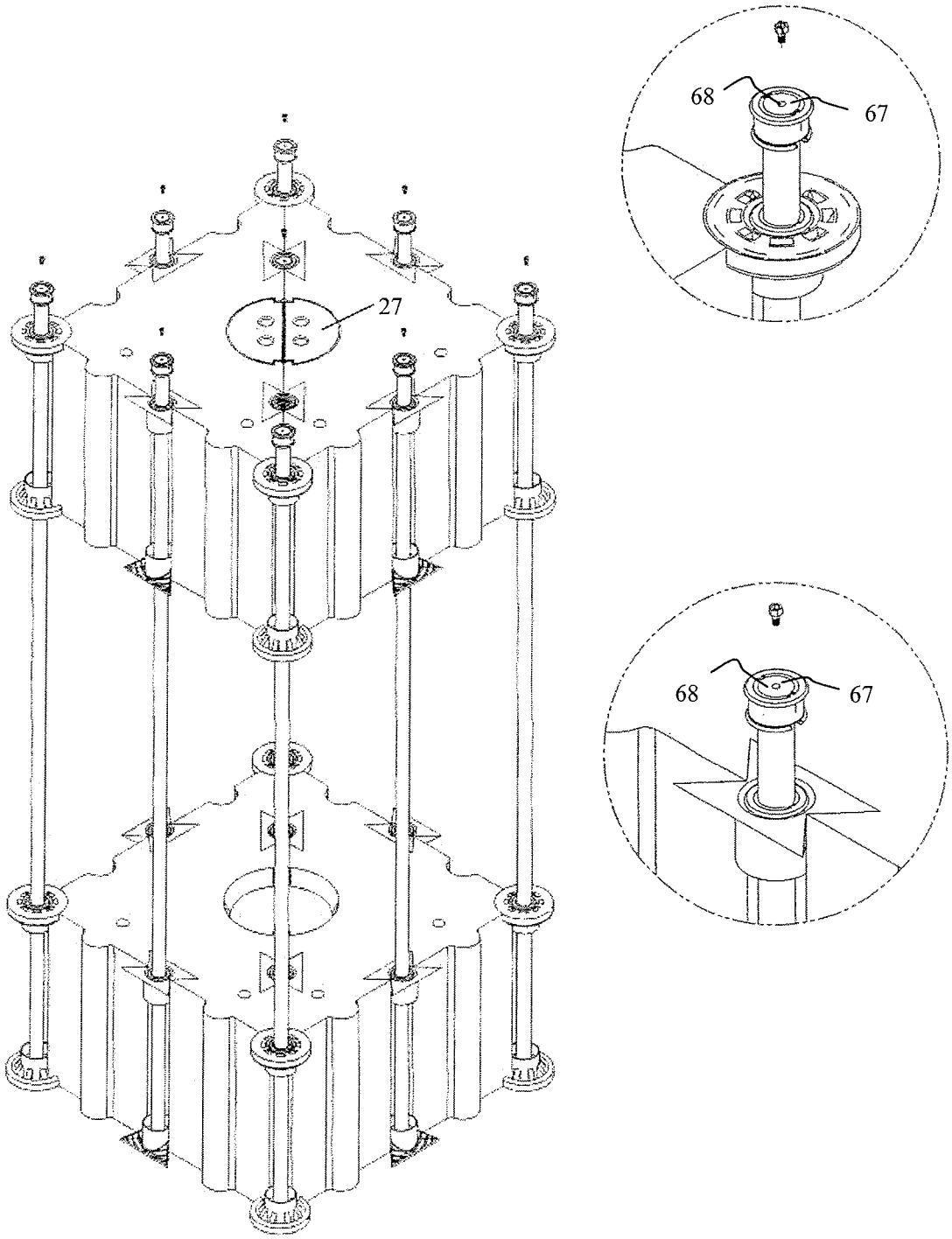
FIG. 22 shows an example of a two-floor floating structure constructed from the floating units and the locks according to this invention.

FIG. 22 shows an example of the floating structure constructed from the floating units and the locks according to this invention, wherein the same parts are referred to by the same reference numbers, and they will not be repeatedly described.

FIG. 22 shows a horizontal lock-connecting method of the hollow right isosceles triangular prism-shaped floating units and the hollow half-cylindrical auxiliary floating units 27 having the external structure for facilitating lock-connecting of external connecting devices.

According to the enlarged views in FIG. 22, said lock-inserting element 67 also further comprises a hole 68 on its upper portion, wherein the hole 68 is provided with internal threads for fastening in order to install external devices such as for installing and connecting of other structures or other auxiliary devices such as metal posts or electrical conduits by using screws for fastening the other auxiliary devices into said holes, etc., and the holes 68 may be provided with female threads.

FIG. 23 shows the second example of a three-floor floating structure constructed by attaching the various floating units as previously described.

Furthermore, the structure of the lowest floor floating units may be filled with a material with a density equal to or higher than that of water, so that the lowest floor is submerged in water, therefore, the floating structure is more stable.

As described above, the floating unit according to this invention is the floating unit capable of attaching to another floating unit by the locks for constructing the floating structure, wherein the floating unit comprises a floating body being in the form of a hollow polygonal shape as viewed from above. The floating body comprises an upper surface, a lower surface, and a plurality of lateral surfaces connected to said upper surface and said lower surface. Said upper surface and said lower surface of the floating body respectively comprise at least one upper engaging surface and at least one lower engaging surface respectively on each associated side of said polygonal floating body, wherein the upper and lower engaging surface are respectively adapted in order to be fitted with a locking surface of said lock. Therefore, said floating body can be attached to a floating body of another floating unit. The floating unit and the floating structure according to this invention is simple and not complex, so that the manufacturing cost is low, and each floating unit can be locked together by the locks without using screws, so that the floating units can be easily assembled and firmly attached together.

While this invention has been described in the detailed description and illustrated in the accompanying drawings, it will be evident to persons having ordinary skill in the art that various modifications and changes may be made therein without departing from the scope and objectives of this invention. The scope of this invention complies with this invention as stated in the appended claims. However, the scope of this invention is not only particularly covered in the claims, but it is also covered those of its utilization and the likes of the embodiments of this invention as stated in the claims.

The invention claimed is:

1. A floating unit capable of attaching to another floating unit by locks for constructing a floating structure, said floating unit comprising:

a floating body being in the form of a hollow polygonal shape as viewed from above, wherein the floating body comprises an upper surface, a lower surface, and a plurality of lateral surfaces connected to said upper and lower surfaces, said floating unit being characterized in that:

said upper surface and said lower surfaces of the floating body comprise at least one upper engaging surface (200) and at least one lower engaging surface (202) respectively on each associated side of said polygonal floating body, wherein the upper and lower engaging surfaces (200, 202) are respectively adapted in order to be fitted with a locking surface of said lock, thereby, attaching said floating body to a floating body of another floating unit, and said upper and lower engaging surfaces (200, 202) of said floating body respectively comprise notches (12), each of which has a contact surface inclined outwardly of said floating body, wherein, in use, the corresponding contact surfaces of the notches of said upper engaging surface and the corresponding contact surfaces of the notches of said lower engaging surface (202) are snugly in contact with the locking surfaces of said locks, thereby, attaching said floating unit to another floating unit without using fastening means, wherein the floating unit further comprising an external device installing channel (300), wherein the channel is in the form of a semicircular channel extended from the upper surface to the lower surface, such that the channel can facilitate connection of the external connecting device in both horizontal and vertical directions.

2. The floating unit according to claim 1, wherein said upper engaging surface (200) is substantially identical to said lower engaging surface (202).

3. The floating unit according to claim 1, wherein said notches of said upper and lower engaging surface (200, 202) are in the form of an inwardly widening indentation.

4. The floating unit according to claim 1, wherein the floating body further comprising a plurality of main concave portions (1) extended between said upper engaging surface (200) and said lower engaging surface (202), such that said locks can be inserted into said main concave portions.

5. The floating unit according to claim 1, wherein said notch (12) has a trapezoidal shape or a semicircular shape as viewed in a plan view.

6. The floating unit according to claim 5, wherein, as viewed from above, said notch (12) has a semicircular shape, and said main concave portion (1) has a semicircular shape, such that a circumference of said notch (12) is intersected to a circumference of said main concave portion (1).

7. The floating unit according claim 1, wherein said floating body being of the polygonal shape selected from the group consisting of an equilateral triangle, a right isosceles triangle, a square, a rectangle, or a hexagon.

8. The floating unit according to claim 1, wherein at least one lateral surface of the floating body further comprises at least one engaging recess (6) and/or at least one engaging projection (7), such that said recess and projection are respectively extended between said upper engaging surface (200) and said lower engaging surface (202), and said engaging recess (6) is shaped in order to be snugly engaged to the engaging projection (7) of another floating unit, so that the floating units can be attached together.

9. The floating unit according to claim 1, further comprising a cylindrical unit (27), wherein the cylindrical unit is shaped, so that it can be fitted into said external device installing channel (300) in order to close said channel, when it is not in use.

10. The floating unit according to claim 1, wherein the floating body further comprises at least one hole (8), which is not penetrated through the wall of the floating body, on the upper surface and/or the lower surface of the floating body, such that the hole can serve as a hole for filling a material into said floating body, so that the floating unit is submerged in water as required, or the hole can serve as a hole for filling air into said floating unit, so that the floating unit is lifted up.

11. The floating unit according to claim 1, wherein the floating body further comprises an anti-slip layer arranged on the upper surface and/or the lower surface of said floating body.

12. A floating unit capable of attaching to another floating unit by locks for constructing a floating structure, said floating unit comprising:

a floating body (100) being in the form of a hollow polygonal shape as viewed from above, wherein the floating body comprises an upper surface (101), a lower surface (103), and a plurality of lateral surfaces (105) connected to said upper and lower surfaces (101, 103), said floating unit characterized in that:

said upper surface (101) and said lower surfaces (103) of the floating body (100) comprise at least one upper engaging surface (200) and at least one lower engaging surface (202) respectively on each associated side of said polygonal floating body, wherein the upper and lower engaging surfaces (200, 202) are respectively adapted in order to be fitted with a locking surface of said lock, thereby, attaching said floating body to a floating body of another floating unit, and said upper and lower engaging surfaces (200, 202) of said floating body respectively comprise a peripheral groove (10) and a radial groove(s) (2) communicated with said peripheral groove (10), in which contact surfaces of said upper engaging surface (200) and said lower engaging surface (202) are inclined, wherein, in use, the corresponding peripheral grooves (10), radial recesses (2) and contact surfaces of said upper engaging surface (200) and of said lower engaging surface (202) are contacted with the locking surfaces of said locks, thereby, attaching said floating unit to another floating unit.

13. The floating unit according to claim 12, wherein said upper engaging surface (200) is substantially identical to said lower engaging surface (202).

14. The floating unit according to claim 13, wherein said groove and contact surface have a semicircle shape as viewed from above, such that the radius of the peripheral groove is larger than that of said concave portion.

15. The floating unit according to claim 12, wherein said contact surface comprises a plurality of grooves (2), each being configured such that the grooves are equally radially spaced apart from each other.

16. The floating unit according to claim 15, wherein said grooves (2) are respectively configured such that they are outwardly inclined.

17. The floating unit according to claim 12, wherein the floating body further comprising a plurality of main concave portions (1) extended between said upper engaging surface (200) and said lower engaging surface (202), such that said locks can be inserted into said main concave portions.

18. The floating unit according to claim 12, wherein said floating body being in the form of the polygonal shape is either shape selected from the group consisting of an equilateral triangle, a right isosceles triangle, a square, a rectangle, or a hexagon.

19. The floating unit according to claim 12, wherein at least one lateral surface of the floating body further comprises at least one engaging recess (6) and/or at least one engaging projection (7), such that said recess and projection are respectively extended between said upper engaging surface (200) and said lower engaging surface (202), and said engaging recess (6) is shaped in order to be snugly engaged to the engaging projection (7) of another floating unit, so that the floating units can be attached together.

20. The floating unit according to claim 12, further comprising an external device installing channel (300), wherein the channel is in the form of a semicircular channel extended from the upper surface to the lower surface, so that the channel can facilitate connection of the external device in both horizontal and vertical directions.

21. The floating unit according to claim 12, further comprising a cylindrical unit (27), wherein the cylindrical unit is shaped, such that it can be fitted into said external device installing channel (300) in order to close said channel, when it is not muse.

22. The floating unit according to claim 12, wherein the floating body further comprises at least one hole (8), which is not penetrated through the wall of the floating body, on the upper surface and/or the lower surface of the floating body, such that the hole can serve as a hole for filling a material into said floating body, so that the floating unit is submerged in water as required, or the hole can serve as a hole for filling air into said floating unit, so that the floating unit is lifted up.

23. The floating unit according to claim 12, wherein the floating body further comprises an anti-slip layer arranged on the upper surface and/or the lower surface of said floating body.

24. A floating structure comprising a plurality of locks, wherein each said floating unit is attached to another floating unit by said locks, characterized in that said lock comprising:

a locking rod (55) being in the form of a hollow cylindrical rod with at least two holes (58) pierced through the wall of said locking rod (55) and located adjacent to one end of said locking rod (55);

a lock-connecting element (36) having a central through hole (37) adapted for snugly inserting of said locking rod (55) through said through hole (37), wherein said lock-connecting element (36) comprises an engaging surface capable of snugly engaging with said upper engaging surface (200) or said lower engaging surface (202) of said floating unit;

a pair of lock-engaging elements (63), wherein each lock-engaging element (63) is in the form of an arc-shaped portion capable of snugly enclosing the outside of the locking rod (55), and the inside of each lock-engaging element (63) is provided with at least one latch (65) for snugly inserting into the corresponding hole (58) of the locking rod (55), while said pair of lock-engaging elements (63) is enclosed the outside of the locking rod (55); and a lock-inserting element (59) for putting on and covering on the end of the locking rod (55), while the outside of the locking rod (55) is snugly enclosed by the pair of said lock-engaging elements (63), wherein, in use, an edge of each lock-engaging element (63) is abutted on the corresponding lock-connecting element (36), such that the engaging surface of said lock-connecting element (36) is locked onto said corresponding upper or lower engaging surfaces (200 or 202) of at least two floating units together, whereby the floating units can be locked and attached together, and the floating structure can be constructed therefrom.

25. The floating structure according to claim 24, wherein said lock-engaging element (63) further comprises a flange (64) outwardly projected from the edge along the circumference of said lock-engaging elements (63) for abutting with said lock-connecting element (36).

26. The floating structure according to claim 24, wherein said lock-engaging elements (63) further comprises at least one through hole (66) on its side, and said lock further comprises a lock-inserting element (67) shaped in order to be snugly put on and cover the hole (56) of the locking rod (55), and the lock-inserting element has protrusions (69) for insetting into said corresponding through holes (66) of said lock-engaging elements (63) in order to fasten them together.

27. The floating structure according to claim 26, wherein said protrusion (69) of the lock-inserting element (67) further comprises a concave groove (70) used for positioning, and said lock-inserting element (59) is further provided with a button (62) for position determination, wherein, in use, said button (62) of said lock-inserting element (59) is fitted into the concave groove (70) of said protrusion (69) of said lock-inserting element (67).

28. The floating structure according to claim 24, wherein said structure comprises a plurality of floating units assembled into the first floor, and a plurality of floating units assembled into the second floor vertically spaced apart from said first floor.

29. The floating structure according to claim 28, wherein said first floor is filled with a material with a density higher than that of water into the inside of said floating unit.

30. The floating structure according to claim 26, wherein said lock-inserting element (67) further comprises a hole (68) on its upper portion, such that the hole (68) is provided with internal threads for installing the external device by a screw.

31. The floating unit according to claim 10, wherein said at least one hole (8) is provided with internal threads for closing the hole by a threaded plug.

* * * * *